US005175074A

United States Patent [19]

Yagihara et al.

[11] Patent Number: 5,175,074

[45] Date of Patent: * Dec. 29, 1992

[54] SILVER HALIDE PHOTOGRAPHIC MATERIALS

[75] Inventors: Morio Yagihara; Kazunobu Katoh, both of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 784,737

[22] Filed: Oct. 29, 1991

Related U.S. Application Data

[63] Continuation of Ser. No. 520,420, May 8, 1990, abandoned.

[30] Foreign Application Priority Data

May 8, 1989 [JP] Japan ..... 1-114456

[51] Int. Cl.[5] ..... G03C 1/06

[52] U.S. Cl. ..... 430/264; 430/598; 430/957

[58] Field of Search ..... 430/222, 223, 264, 566, 430/592, 544, 546, 598, 957

[56] References Cited

U.S. PATENT DOCUMENTS

| | | | |
|---|---|---|---|
| 4,684,604 | 8/1987 | Harder | 430/375 |
| 4,798,780 | 1/1989 | Hall et al. | 430/264 |
| 4,824,764 | 4/1989 | Inagaki et al. | 430/264 |
| 4,914,002 | 4/1990 | Inoue et al. | 430/264 |
| 4,950,578 | 8/1990 | Yagihara et al. | 430/264 |
| 5,006,445 | 4/1991 | Yagihara et al. | 430/264 |

FOREIGN PATENT DOCUMENTS

| | | |
|---|---|---|
| 61-213847 | 9/1986 | Japan . |
| 62-245263 | 10/1987 | Japan . |
| 63-046450 | 2/1988 | Japan . |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material suitable for photomechanical process is disclosed, which has at least one silver halide photographic emulsion hydrophilic colloid layer and contains at least one redox compound capable of releasing a development inhibitor by oxidation and at least one compound of general formula (I') in the photographic emulsion layer or in at least one other hydrophilic colloid layer:

(I')

wherein the variable terms are as defined in the specification.

5 Claims, 1 Drawing Sheet

SILVER HALIDE PHOTOGRAPHIC MATERIALS

This is a continuation of application Ser. No. 07/520,420 filed May 8, 1990 now abandoned.

FIELD OF THE INVENTION

The present invention relates to silver halide photographic materials and, more precisely, to those having a high sensitivity which are capable of forming hard negative images, especially excellent halftone dot images of a high contrast.

BACKGROUND OF THE INVENTION

In the field of photomechanical process technology, photographic materials with excellent original-producibility, stable processing solutions and simplified replenishment systems are required to deal with diversified and complicated print forms.

Originals to be employed in a line work process are often composed of phototypeset letters, hand-written letters, illustrations and halftone dot image photographs. Accordingly, the originals often combine several images having a different concentration and a different line width. Photomechanical cameras and photographic materials capable of finishing the images from such originals with good reproducibility, as well as image-forming methods applicable to such photographic materials, are needed in this field. On the other hand, in photomechanical processes for producing catalogs or large-sized posters, a blow-up or reduction of the dot image photographs is often performed. In the photomechanical processes using enlarged dot images, the dots are coarsened to give blurred photoprints. On the other hand, in the photomechanical processes for forming reduced photoprints, fine dots with an enlarged ratio of lines/inch are to be photographed. Accordingly, an image-forming method with a much broader latitude is desired to maintain the reproducibility of halftone dot images in these photomechanical processes.

As the light source for a photomechanical camera, a halogen lamp or xenon lamp is employed. In order to obtain a sufficient photographing sensitivity to the light source, the photographic material employed in the photomechanical process is generally ortho-sensitized. However, it was found that the ortho-sensitized photographic materials are much more influenced by the chromatic aberration of the lens and therefore the quality of the images formed is frequently reduced because of that influence. It was further found that the deterioration of the image quality is more noticeable where a xenon lamp is used as the light source.

As a system for satisfying the demand for the broad latitude, a method is known in which a lith-type silver halide photographic material composed of silver chlorobromide (having a silver chloride content of at least 50% or more) is processed with a hydroquinone-containing developer in which the effective concentration of the sulfite ion therein is extremely low (generally, to 0.1 mol/liter or less) to obtain a line image or halftone dot image having a high contrast and a high blackened density in which the image portions and the non-image portions are clearly differentiated from each other. However, the method has various drawbacks. Specifically, since the sulfite concentration in the developer to be employed in the method is low, development is extremely unstable to aerial oxidation. To stabilize the activity of the processing solution, various means must be used. As a result, the processing speed is extremely slow, and the working efficiency is poor.

Accordingly, an improved image-forming system is desired, which is free from the instability of image formation during the above-mentioned development method (lith-development system) and which may be processed with a processing solution having an excellent storage stability to give photographic images having ultra-hard photographic characteristics. As one example, a system of forming an ultra-hard negative image having a gamma value of more than 10 has been proposed, for example, in U.S. Pat. Nos. 4,166,742, 4,168,977, 4,221,857, 4,224,401, 4,243,739, 4,272,606 and 4,311,781. In that system, a surface latent image-type silver halide photographic material containing a particular acylhydrazine compound is processed with a developer which has an excellent storage stability and which contains a sulfite preservative in an amount of 0.15 mol/liter or more, at a pH value of from 11.0 to 12.3. The image-forming system is characterized by the fact that a silver iodobromide- or silver chloroiodobromide-containing photographic material can be processed, while only a high silver chloride content-having silver chlorobromide photographic material can be processed by the conventional ultra-hard image-forming method.

The image-forming system is excellent in that an image with a sharp halftone dot image quality is formed, the process proceeds stably at a high speed, and the reproducibility of the original is good. However, a further improved system with a further elevated original reproducibility is still desired for the purpose of satisfactorily dealing with diversified print forms.

Additionally, it is desirable to perform plate making work and dot to dot work in a light environment to improve working efficiency. Therefore, development of photographic materials for photomechanical process which can be handled under a condition that can be called substantially a daylight room as well as development of an exposure printer usable for the materials has been undertaken.

Photographic materials for daylight use, as referred to herein, mean those which can be safely used for a long period of time under a safelight having a wavelength of substantially 400 nm or more without ultraviolet components.

The daylight photographic materials used in the plate making work and the dot to dot work are those which are utilized for negative image/positive image conversion or positive image/positive image conversion in which an original of a developed film having letter or halftone dot images thereon is contacted with a dot-to-dot working photographic material for contact exposure. The materials must satisfy the following two requirements:

(1) in the negative image/positive image conversion with the materials, the halftone dot images as well as line images and letter images can be converted in accordance with the dot area, line width and letter image width; and (2) tone regulation of the halftone dot images as well as regulation of the line width of the letter and line images is possible.

Accordingly, various photographic materials for daylight dot to dot work which may satisfy these requirements have heretofore been proposed.

However, in high technological image-conversion work, for example, in the formation of super-imposed letter images by contact dot-to-dot work, the conventional method of conducting the daylight dot-to-dot work step by using a daylight photographic material is inferior to the dark dot-to-dot work method of using conventional dark dot-to-dot work photographic material. Specifically, the quality of the super-imposed letter images formed by the former is worse than that of the images formed by the latter.

The method of forming super-imposed letter images by contact dot-to-dot work will be explained in more detail hereunder with reference to the sole Figure of this specification. As shown in the Figure, transparent or semitransparent supports (a) and (c) (generally, polyethylene terephthalate film having a thickness of approximately 100 μm is used) are attached to a letter or line image-containing film (line original) (b) and a halftone dot image-containing film (halftone original) (d), respectively, to form a combined original, and a dot-to-dot working photographic material (e) is brought into contact with the halftone original (d) so that the emulsion surface of the material (e) faces and contacts the halftone image surface of the original (d). Then the material is exposed to light through the combined original by contact exposure.

After exposure, the material is developed to form transparent line image portions in the dot images.

The important point in this method of forming super-imposed letter images is that the negative image/positive image conversion is ideally effected in accordance with the dot area and the line width of the halftone original and the line original, respectively. However, as is obvious in the Figure, the line original is exposed to the dot-to-dot working photographic material (e) via the support (c) and the halftone original (d), while the halftone original (d) is directly exposed to the emulsion surface of the material (e) by contact exposure therewith.

Accordingly, if an exposure amount sufficient for faithful negative/positive conversion of the halftone original is imparted to the material, it would be an out-of-focus exposure to the line original because of the spacers of the support (c) and the halftone original (d) so that the line width in the transparent line image portions in the dot images formed would be narrow. This is the reason for the reduction in the quality of the transparent line image portions in the dot images formed.

In order to overcome the above-mentioned problems, a system of using hydrazine has been proposed, for example, in JP-A-62-80640, JP-A-62-235938, JP-A-62-235939, JP-A-63-104046, JP-A-63-103235, JP-A-63-296031, JP-A-63-314541 and JP-A-64-13545. (The term "JP-A" as used herein means an "unexamined published Japanese patent application".) However, the system is not sufficient and further improvement of the system is desired.

As a means of improving the original-reproducibility and improving the quality of the super-imposed letter image formed, for example, a method of silver-image-wise releasing a development inhibitor from a carbonyl group-containing redox compound is known, as illustrated in JP-A-61-213847 or JP-A-64-72139. However, the method is still unsatisfactory because it fails to achieve both sharp dot image quality (which is one characteristic merit of the system of using a hydrazine derivative) and sufficient processing stability (such stability measuring that the fluctuation of the quality of the image formed is negligible with respect to the variation of the pH value, the sodium sulfite content and the developer composition in the processing system).

Accordingly, it is desired to develop a means for producing with a stable developer photographic images which are hardly influenced by the fluctuation of the composition of the processing solution used and which have a sharp halftone dot image quality, an excellent original-reproducibility and an excellent super-imposed letter image quality.

SUMMARY OF THE INVENTION

One object of the present invention is to provide a photographic material which has a broad exposure latitude in line image-taking work and a high resolving power in that work and which is able to form ultra-hard images (especially having a gamma value of 10 or more).

Another object of the present invention is to provide a photographic material which can be handled under daylight condition and which may form a super-imposed letter image of high quality with no mosaic tape trace.

A further object of the present invention is to provide a photographic material which may excellently reproduce a line original to form an ultra-hard image having a high background density ($D_{max}$).

A still further object of the present invention is to provide a photographic material which may form an ultra-hard image whose quality is hardly influenced by the fluctuation of the composition of the solution used for processing the material.

These and other objects of the present invention have been attained by a silver halide photographic material which contains at least one redox compound capable of releasing a development inhibitor by oxidation and at least one compound of the following general formula (I):

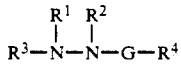

(I)

wherein $R^1$ and $R^2$ are both hydrogen atoms, or one of them is a hydrogen atom and the other represents a sulfonyl group or an acyl group;

$R^3$ represents a group selected from an aliphatic group, an aromatic group and a heterocyclic group;

$R^4$ represents a group selected from a hydrogen atom, an alkyl group, an aryl group, an alkoxy group, an aryloxy group, an amino group, an oxycarbonyl group and a carbamoyl group;

at least one of $R^3$ and $R^4$ is substituted at the position of a hydrogen atom contained therein by a group which has a function of accelerating adsorption of the compound of formula (I) to silver halide grains and is represented by $X—(L)_l—$ where X represents a group selected from a cyclic thioamido-containing group, a mercapto-containing group, a disulfido bond-containing group and a 5-membered or 6-membered nitrogen-containing heterocyclic group, L represents a divalent linking group, and l represents an integer of 0 or 1; and G represents a divalent group selected from a carbonyl group, a sulfonyl group, a sulfinyl group, an iminomethylene group and

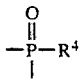

where $R^4$ is as defined above.

BRIEF DESCRIPTION OF THE DRAWINGS

The sole FIGURE of the drawing shows the structure of one embodiment for the formation of superimposed letter images by contact exposure work, wherein 1(A) is a first transparent or semitransparent support, 1(B) is a line original in which the black portions indicate line images, 1(C) is a second transparent or semitransparent support, 1(D) is a halftone original in which the black portions indicate dot images, and 1(E) is a dot-to-dot working photographic material in which the shadow portion indicates a light-sensitive layer.

DETAILED DESCRIPTION OF THE INVENTION

Figures 1A, 1B, 1C, 1D, 1E:
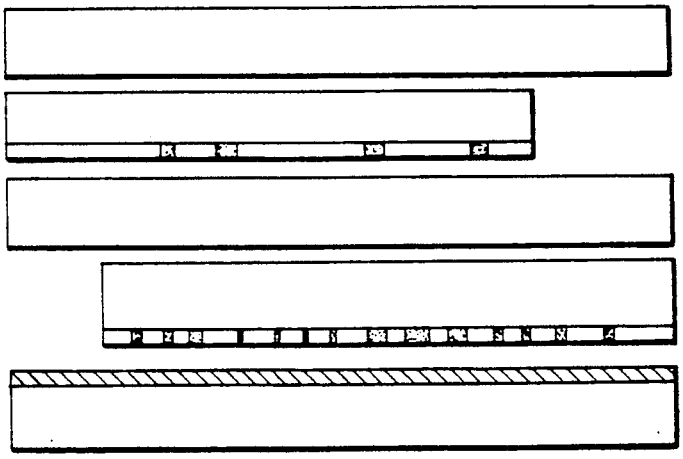

The compounds of formula (I) will be explained in detail hereunder.

In formula (I), $R^1$ and $R^2$ are both hydrogen atoms, or one of them is a hydrogen atom and the other is a sulfonyl group or an acyl group.

The sulfonyl group represented by $R^1$ or $R^2$ is preferably an alkylsulfonyl or arylsulfonyl group having 20 or less carbon atoms. More preferably, it is an unsubstituted phenylsulfonyl group or a phenylsulfonyl group which is substituted so that the sum of the Hammett's substituent constants is −0.5 or more.

The details of the sulfonyl group for $R^1$ and $R^2$ are described in U.S. Pat. No. 4,478,928.

The acyl group represented by $R^1$ or $R^2$ may be one having 20 or less carbon atoms. Preferably, it is an unsubstituted benzoyl group, a benzoyl group which is substituted so that the sum of the Hammett's substituent constants is −0.5 or more, a linear or branched aliphatic acyl group, or a cyclic aliphatic acyl group. The group represented by $R^1$ or $R^2$ may have further substituent(s). Examples of such substituents include a halogen atom, an ether group, a sulfonamido group, a carbonamido group, a hydroxyl group, a carboxyl group and a sulfonic acid group.

It is especially preferred that both $R^1$ and $R^2$ are hydrogen atoms.

$R^3$ in formula (I) represents a group selected from an aliphatic group, an aromatic group and a heterocyclic group.

The aliphatic group represented by $R^3$ includes a linear, branched or cyclic alkyl, alkenyl or alkynyl group, preferably having up to 20 carbon atoms.

The aromatic group represented by $R^3$ may be a monocyclic or bicyclic aryl group, which includes, for example, a phenyl group and a naphthyl group.

The heterocyclic group represented by $R^3$ may be a 3-membered to 10-membered unsaturated or saturated heterocyclic group having at least one nitrogen, oxygen or sulfur atom, which may be monocyclic or may form a condensed ring along with other aromatic ring(s) and/or hetero ring(s). The heterocyclic group is preferably a 5-membered or 6-membered aromatic heterocyclic group, which may be for example, a pyridyl group, an imidazolyl group, a quinolyl group, a benzimidazolyl group, a pyrimidyl group, a pyrazolyl group, an isoquinolinyl group, a thiazolyl group and a benzothiazolyl group.

The group $R^3$ may further be substituted by one or more substituents, and the substituents, if there are more than one, may be bonded to each other to form a ring. Substituents for $R^3$ include, for example, an alkyl group, an aralkyl group, an alkoxy group, an arylamino group, an amino group, an acylamino group, a sulfonylamino group, an ureido group, an urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a phosphoric acid amido group and a carboxyl group.

The group $R^3$ is preferably an aromatic group, more preferably a phenyl group.

$R^4$ in formula (I) represents a group selected from a hydrogen atom, an alkyl group, an aryl group, an alkoxy group, an aryloxy group, an amino group, an oxycarbonyl group and a carbamoyl group. The alkyl moiety and the aryl moiety in the above group $R^4$ preferably have 1 to 20 carbon atoms and 6 to 20 carbon atoms, respectively.

The group $R^4$ may further be substituted by one or more substituents. Examples of the substituents include the substituents mentioned for $R^3$ above, as well as an acyl group, an acyloxy group, an alkyloxycarbonyl group, an aryloxycarbonyl group, an alkenyl group, an alkynyl group and a nitro group.

G in formula (I) represents a divalent group selected from a carbonyl group, a sulfonyl group, a sulfinyl group, an iminomethylene group and

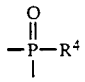

wherein $R^4$ is as defined above.

Where G is a carbonyl group, $R^4$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), an aryl group (e.g., phenyl, 3,5-dichlorophenyl, o-methanesulfonamidophenyl, 4-methanesulfonylphenyl) or a carbamoyl group (e.g., unsubstituted carbamoyl, methylcarbamoyl, phenylcarbamoyl). Above all, a hydrogen atom is preferred as the $R^4$ in this group.

Where G is a sulfonyl group, $R^4$ is preferably an alkyl group (e.g., methyl), an aralkyl group (e.g., o-hydroxyphenylmethyl) or an amino group (e.g., dimethylamino).

Where G is a sulfinyl group, $R^4$ is preferably a cyanobenzyl group or a methylthiobenzyl group.

Where G is

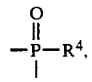

i.e., the portion of G—$R^4$ in formula (I) is

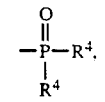

the two $R^4$ may be the same or different, and $R^4$ is preferably a methoxy group, an ethoxy group, a butoxy group, a phenoxy group or a phenyl group and is especially preferably a phenoxy group.

Where G is an N-substituted or unsubstituted iminomethylene group, $R^4$ is preferably a methyl group, an ethyl group or a phenyl group.

In formula (I), G is most preferably a carbonyl group.

In formula (I), $R^4$ may also be such a group that causes release of the —G—$R^4$ moiety from the remaining molecule followed by a cyclization reaction to form a cyclic structure containing the atoms of the thus released —G—$R^4$ moiety. Precisely, such an $R^4$ group is represented by the following formula (a):

$$-R^5-Z \qquad \text{(a)}$$

where Z represents a group which nucleophilically attacks the group G to cleave the —G—$R^5$—Z moiety from the remaining molecule; and $R^5$ represents a group derived from $R^4$ by removing one hydrogen atom therefrom. In the group represented by formula (a), Z is capable of nucleophilically attacking the group G so that G, $R^5$ and Z form a cyclic structure.

More precisely, Z is a group that may easily nucleophilically react with G, when the hydrazine compound of formula (I) forms a reaction intermediate of:

$$R^3-N{=}N-G-R^5-Z$$

by oxidation to cleave the $R^3$—N=N— moiety from the group G. Specifically, Z may be a functional group which directly reacts with the group G, such as OH, SH, $NHR^6$ (where $R^6$ represents a hydrogen atom, an alkyl group preferably having 1 to 20 carbon atoms, an aryl group preferably having 6 to 20 carbon atoms, —$COR^7$ or —$SO_2R^7$; and $R^7$ represents a hydrogen atom, an alkyl group preferably having 1 to 20 carbon atoms, an aryl group preferably having 6 to 20 carbon atoms or a heterocyclic group preferably having 3 to 20 carbon atoms) or COOH, whereupon the OH, SH, $NHR^6$ or COOH groups may be temporarily protected so as to form a free group by hydrolysis with an alkali or the like. Alternatively, Z may be a functional group which may react with the group G after reacting with a nucleophilic agent such as a hydroxyl ion or a sulfite ion. Such a functional group may be, for example,

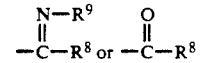

(where $R^8$ and $R^9$ each represents a hydrogen atom, an alkyl group preferably having 1 to 20 carbon atoms, an alkenyl group preferably having 2 to 20 carbon atoms, an aryl group preferably having 6 to 20 carbon atoms or a heterocyclic group preferably having 3 to 20 carbon atoms).

The ring formed by G, $R^5$ and Z is preferably a 5-membered or 6-membered one.

Of the groups represented by formula (a), those represented by the following formulae (b) and (c) are preferred:

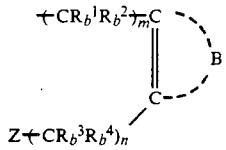

(b)

where $R_b^1$ to $R_b^4$ each represents a hydrogen atom, an alkyl group (preferably having 1 to 12 carbon atoms), an alkenyl group (preferably having 2 to 12 carbon atoms) or an aryl group (preferably having 6 to 12 carbon atoms), and these groups may be the same or different; B represents an atomic group necessary for forming a 5-membered or 6-membered ring which may or may not be substituted; and m and n each represents 0 or 1, and (n+m) is 1 or 2.

Examples of the 5-membered or 6-membered ring to be formed by B include a cyclohexene ring, a cycloheptene ring, a benzene ring, a naphthalene ring, a pyridine ring and a quinoline ring.

Z in formula (b) has the same meaning as in formula (a).

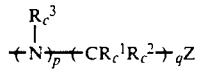

(c)

where $R_c^1$ and $R_c^2$ each represents a hydrogen atom, an alkyl group, an alkenyl group, an aryl group or a halogen atom, and these may be the same or different;

$R_c^3$ represents a hydrogen atom, an alkyl group, an alkenyl group or an aryl group; and p represents 0, 1 or 2 and q represents an integer from 1 to 4.

The alkyl, alkenyl and aryl groups for $R_c^1$, $R_c^2$ and $R_c3$ preferably have 1 to 20 carbon atoms, 2 to 20 carbon atoms and 6 to 20 carbon atoms, respectively.

$R_c^1$, $R_c^2$ and $R_c^3$ may be bonded to each other to form a ring, provided that Z has a structure capable of attacking the group G by intramolecular nucleophilic reaction.

$R_c^1$ and $R_c^2$ each is preferably a hydrogen atom, a halogen atom or an alkyl group; and $R_c^3$ is preferably an alkyl group or an aryl group.

q is preferably an integer from 1 to 3. Preferably, when q is 1, p is 1 or 2; when q is 2, p is 0 or 1; when q is 3, p is 0 or 1; and when q is 2 or 3, the plural (—$CR_c^1R_c^2$)'s may be same or different.

Z in formula (c) has the same meaning as in formula (a).

As noted earlier, at least one of $R^3$ and $R^4$ is substituted by a group which has a function of accelerating adsorption of the compound to silver halide grains at the position of a hydrogen atom in the group and which is represented by the following formula (d):

$$X-(L)_l- \qquad \text{(d)}$$

where

X represents a group selected from a cyclic thioamido-containing group, a mercapto-containing group, a disulfido bond-containing group and a 5-membered or 6-membered nitrogen-containing heterocyclic group;

L represents a divalent linking group; and l represents an integer of 0 or 1.

Specific examples of the cyclic thioamido-containing group represented by X include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. These may further be substituted by one or more substituents. Appropriate thioamido groups may be selected from the groups illustrated in U.S. Pat. Nos. 4,030,925, 4,031,127, 4,080,207, 4,245,037, 4,255,511, 4,266,031, 4,276,364 and *Research Disclosure,* Vol. 151, Item No. 15162 (November, 1976) and ibid., Vol. 176, Item No. 17626 (December, 1978).

As the mercapto-containing group for X, there are mentioned, for example, a mercapto-substituted aliphatic group, a mercapto-substituted aromatic group and a mercapo-substituted heterocyclic group. In the last heterocyclic group, where the mercapto group-bonded carbon atom is adjacent to a nitrogen atom, the compound is essentially the same as the thioamido-containing cyclic group which is a tautomer of the corresponding heterocyclic group. Accordingly, the same examples as those mentioned above in connection with cyclic thioamido groups are appropriate.

The 5-membered or 6-membered nitrogen-containing heterocyclic group for X may be one composed of a combination of at least one nitrogen atom and at least one atom selected from nitrogen, oxygen, and sulfur. Preferred examples of the group include benzotriazole, triazole, tetrazole, indazole, benzimidazole, imidazole, benzothiazole, thiazole, benzoxazole, oxazole, thiadiazole, oxadiazole and triazine. These may be further substituted by one or more substituents. The substituent include those mentioned as substituents of $R^3$.

In the present invention, X is most preferably a mercapto-substituted nitrogen-containing heterocyclic group (or a thioamido group-containing cyclic group), or a 5-membered or 6-membered nitrogen-containing heterocyclic group. Specific examples of the mercapto-substituted nitrogen-containing heterocyclic group include 2-mercaptothiadiazole group, 3-mercapto-1,2,4-triazole group, 5-mercaptotetrazole group, 2-mercapto-1,3,4-oxadiazole group and 2-mercaptobenzoxazole group. Specific examples of the 5- or 6-membered nitrogen-containing heterocyclic group include a benzotriazole group, benzimidazole group and an imidazole group.

The divalent linking group represented by L is an atomic group containing at least one carbon, nitrogen, sulfur or oxygen atom. Examples of the group include an alkylene group, an alkenylene group, an alkynylene group, an arylene group, —O—, —S—, —NH—, —CO— and —$SO_2$—. The group may optionally have one or more substituents. Two or more of the groups may be bonded to each other to form the linking group L.

Specific examples of the linking group L are mentioned below:

—CONH—, —NHCONH—, —$SO_2$NH—, —COO—,

-continued

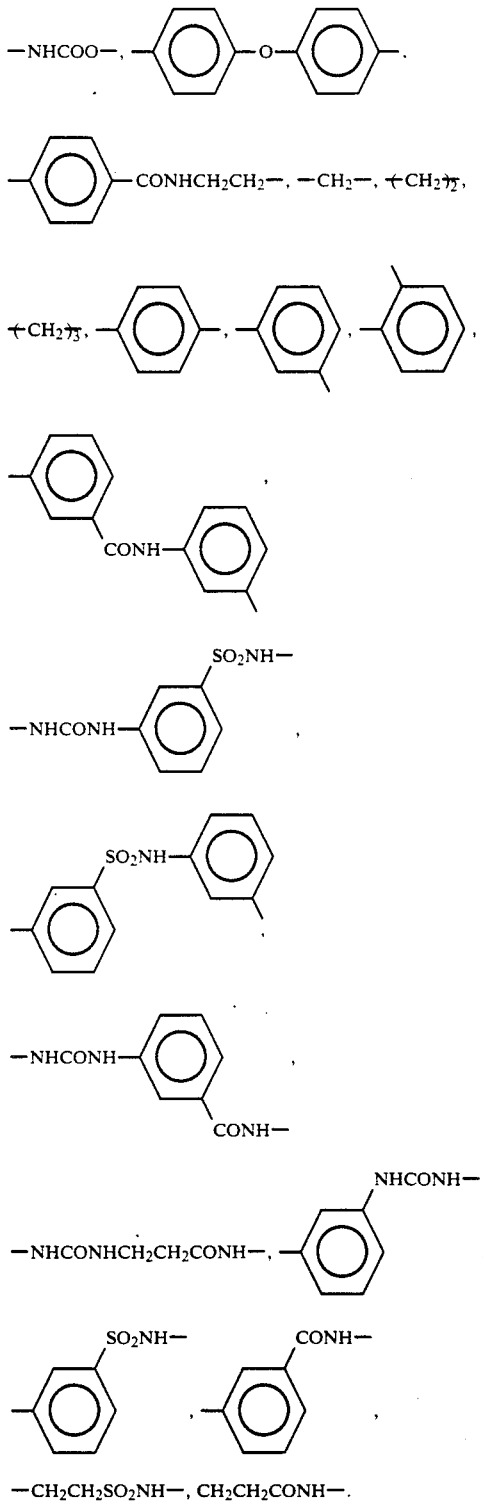

The above-mentioned linking groups may further be substituted by one or more appropriate substituents. As the substituents of the linking group L, if any, the substituents mentioned for $R^3$ above may be referred to.

The group having a function of accelerating adsorption of the compound of formula (I) to silver halide grains is preferably substituted on the group $R^3$ in formula (I).

Of the compounds of formula (I), those represented by the following general formula (I') are preferred:

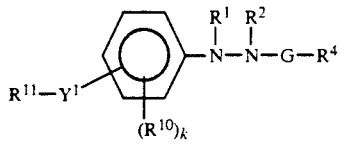

(I')

where $R^{10}$ represents alkyl group, an aralkyl group, an alkoxy group, an arylamino group, an amino group, an acylamino group, a sulfonylamino group, an ureido group, an urethane group, an aryloxy group, a sulfamoyl group, a carbamoyl group, an aryl group, an alkylthio group, an arylthio group, a sulfonyl group, a sulfinyl group, a group, a phosphoric acid amido group, a carboxyl group, or $X—(L)_l—$;

k represents 0, 1 or 2, and when k is 2, the two $R^{10}$ groups may be the same or different;

$R^{11}$ is the same as $R^3$ in formula (I) or represents $—(L)_l—$ X, and is preferably $—(L)_l—X$ (where L, X and l have the same meaning as in formula (d) above;

$Y^1$ represents —CONH—

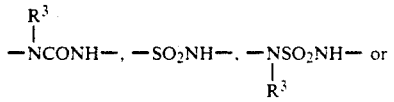

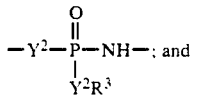

$Y^2$ represents —O—, —NH— or

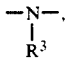

and $R^3$ in each of the above groups has the same meaning as in formula (I); provided that at least one of $R^{10}$ and $R^{11}$ is $X—(L)_l—$ when $R^4$ does not contain a group having a function of accelerating absorption to silver halide grains.

$Y^1$ is especially preferably $—SO_2NH$,

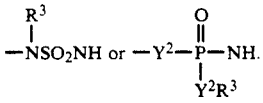

G, $R^1$, $R^2$ and $R^4$ in formula (I') have the same meanings as those in the formula (I). More preferably, the $R^{11}Y^1$— moiety is bonded to the para position with respect to the hydrazine group.

Specific examples of the group which accelerates adsorption of the compound of formula (I) to the surfaces of silver halide grains are also described in U.S. Pat. Nos. 4,385,108, 4,459,347, JP-A-59-195233, JP-A-59-200231, JP-A-59-201047, JP-A-59-201048, JP-A-59-201049, JP-A-61-170733, JP-A-61-170744, JP-A-62-948, JP-A-63-234244, JP-A-63-234245, JP-A-63-234246, JP-A-1-90439 and Japanese Patent Application Nos. 63-105682, 63-116239, 63-147339, 63-179760 and 63-229163, in addition to the above-mentioned patent publications.

Next, specific examples (I-1) to (I-56) of the hydrazine compounds of formula (I) for use in the present invention are mentioned, but they do not limit the scope of the present invention.

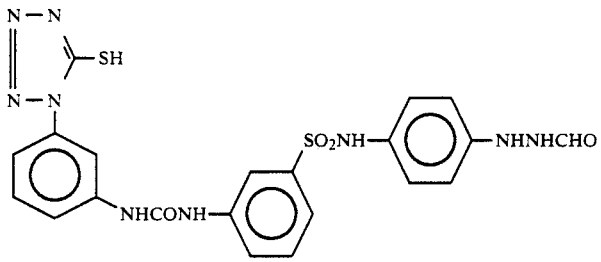

(I-1)

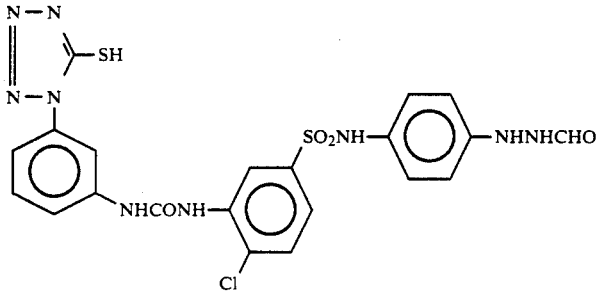

(I-2)

-continued
(I-3)
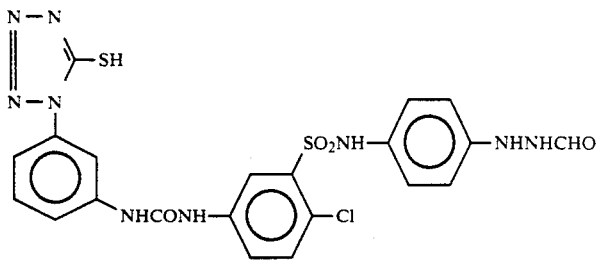
(I-4)
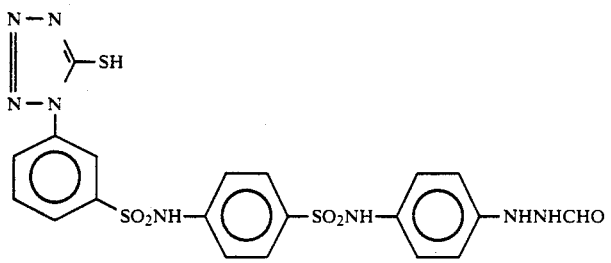
(I-5)
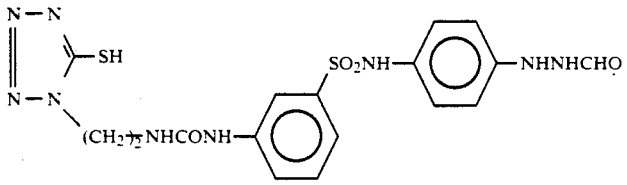
(I-6)
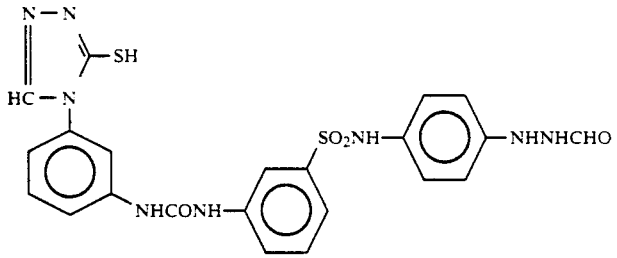
(I-7)
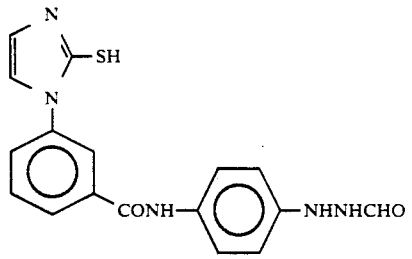
(I-8)
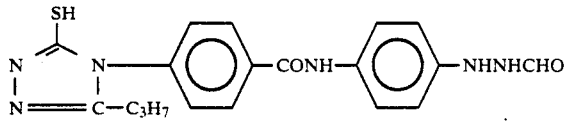
(I-9)
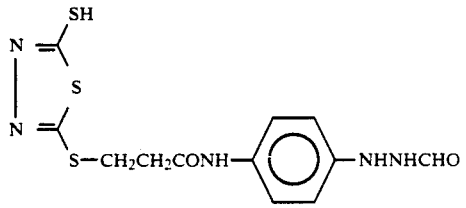

-continued
(I-10)
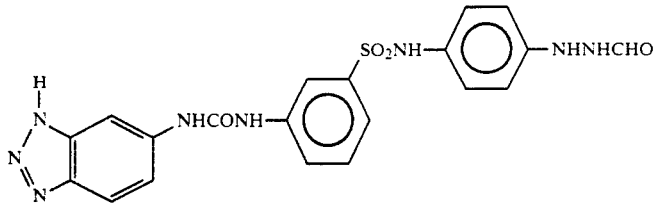
(I-11)
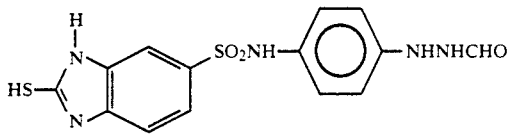
(I-12)
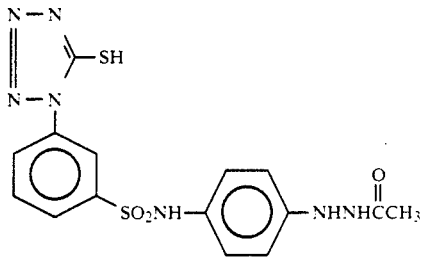
(I-13)
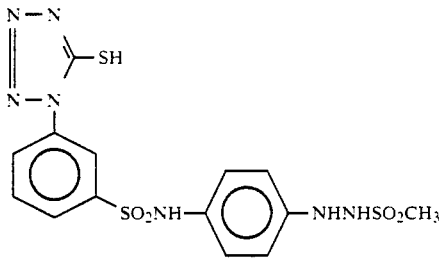
(I-14)
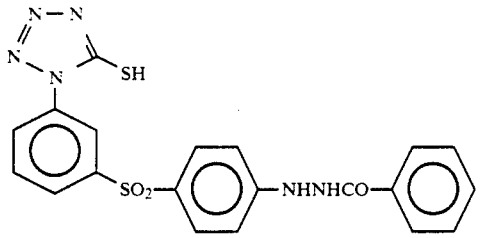
(I-15)
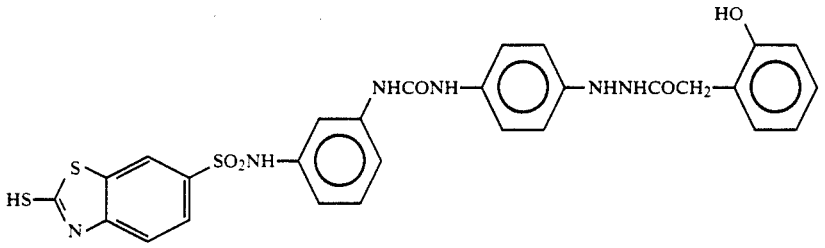

-continued
(I-16)
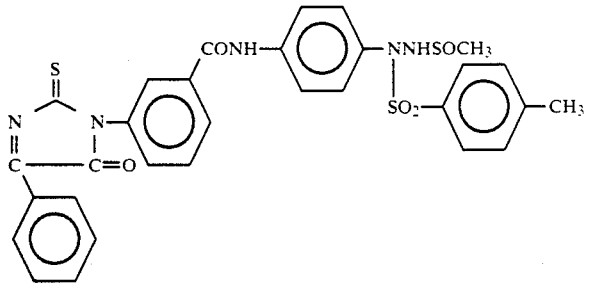
(I-17)
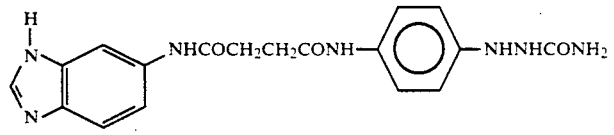
(I-18)
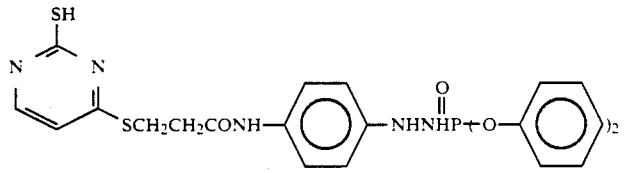
(I-19)
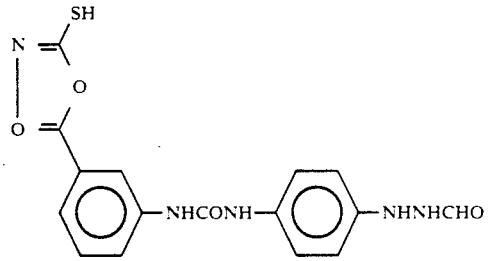
(I-20)
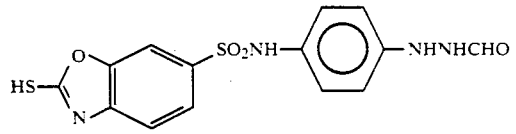
(I-21)
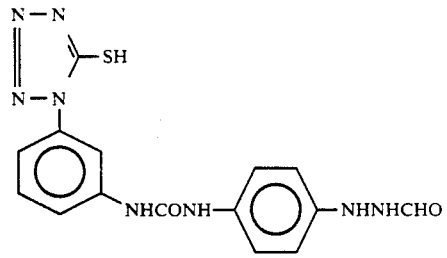
(I-22)
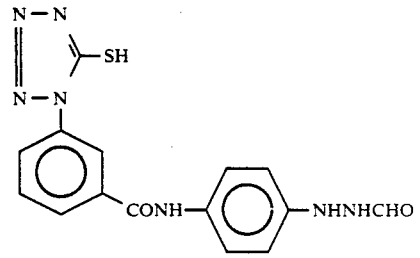

-continued
(I-23)
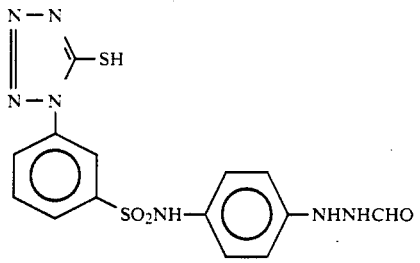
(I-24)
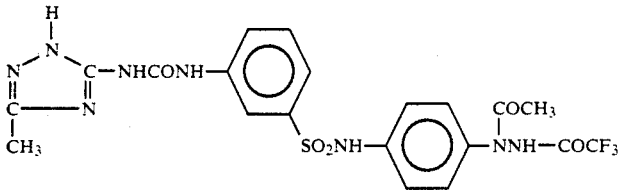
(I-25)
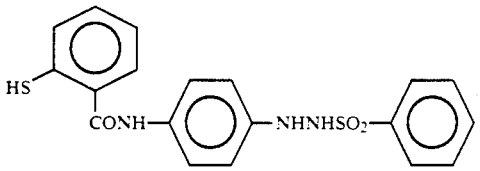
(I-26)
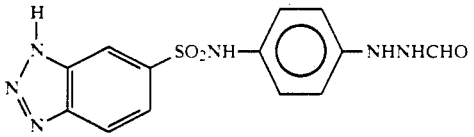
(I-27)
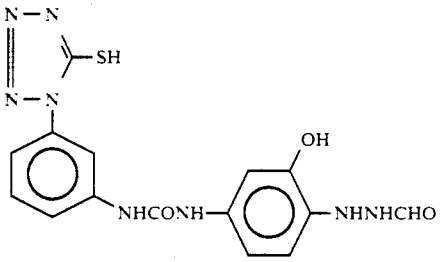
(I-28)
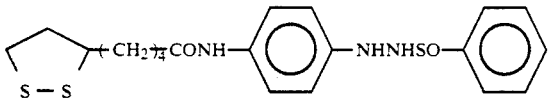
(I-29)
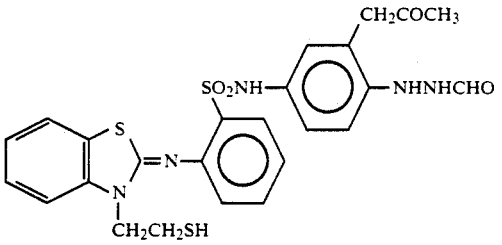
(I-30)
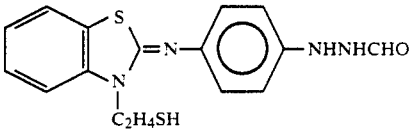

-continued
(I-31)
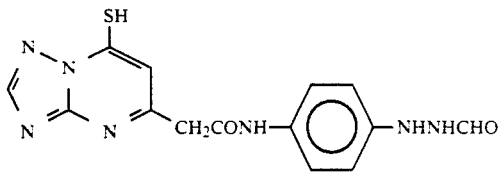
(I-32)
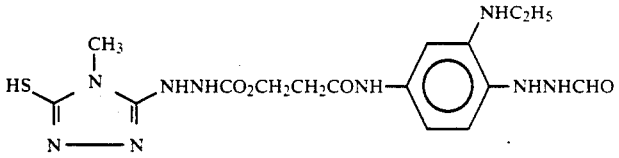
(I-33)
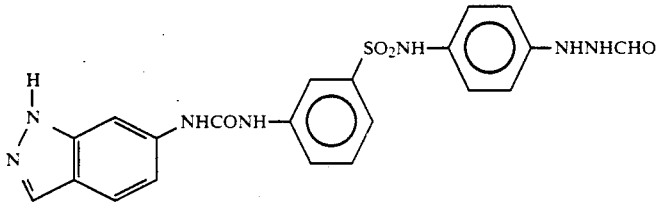
(I-34)
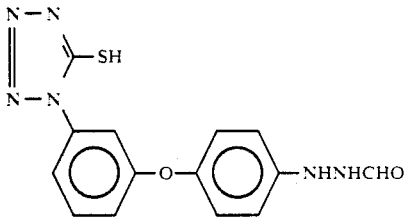
(I-35)
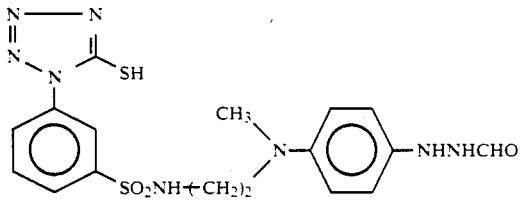
(I-36)
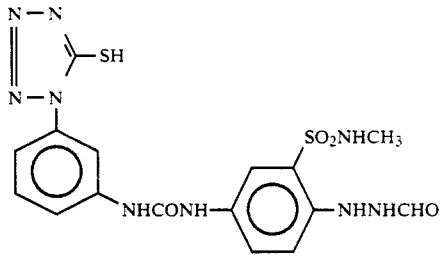
(I-37)
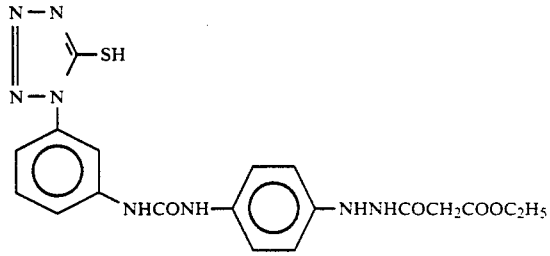

-continued
(I-38)
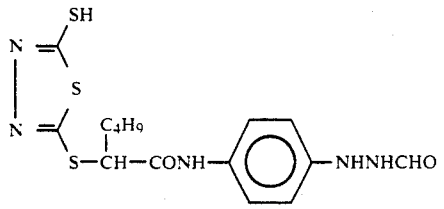
(I-39)
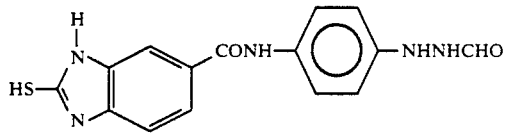
(I-40)
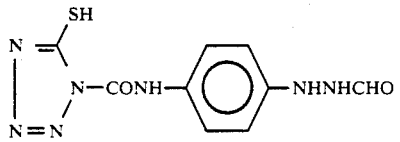
(I-41)
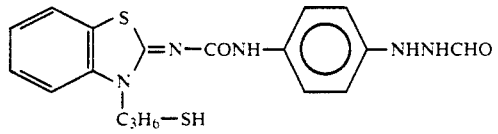
(I-42)
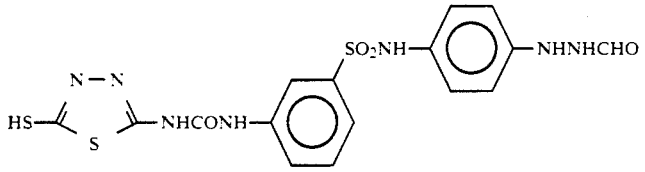
(I-43)
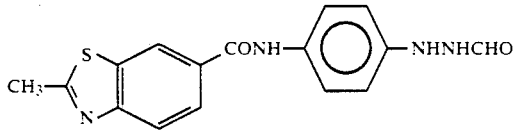
(I-44)
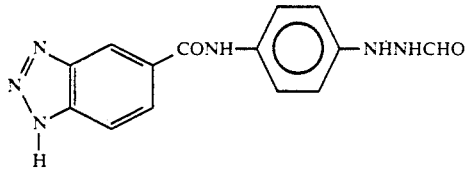
(I-45)
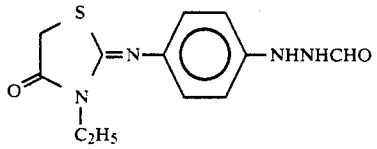
(I-46)
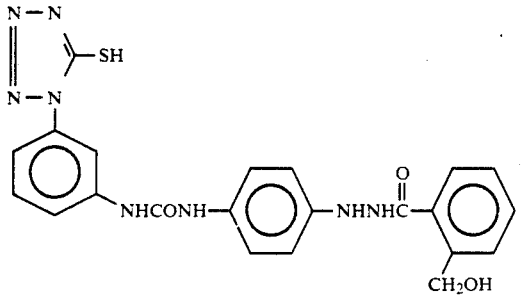

-continued
(I-47)
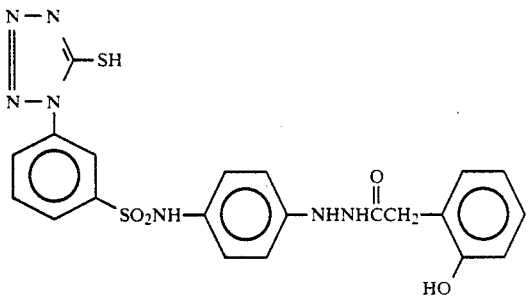
(I-48)
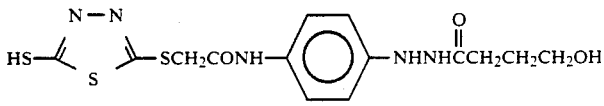
(I-49)
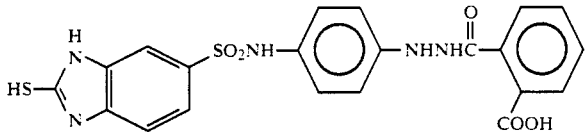
(I-50)
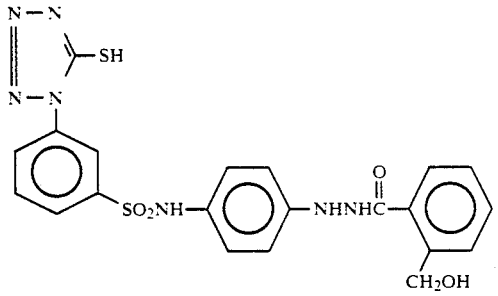
(I-51)
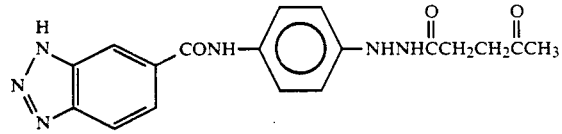
(I-52)
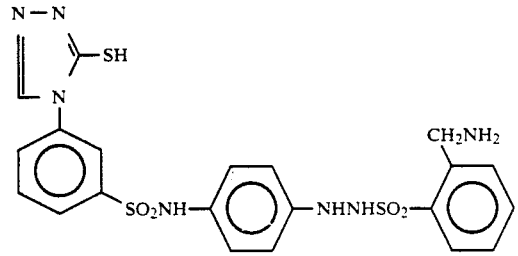

-continued (I-53)

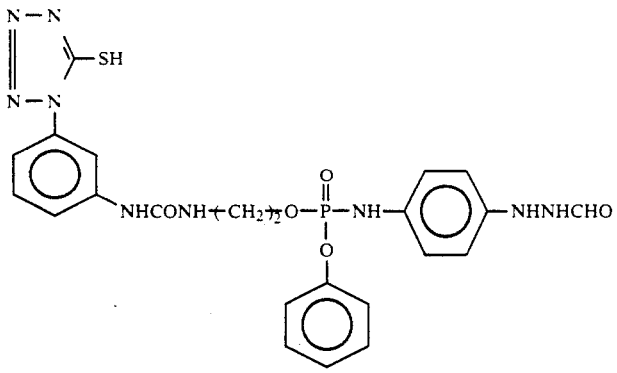

(I-54)

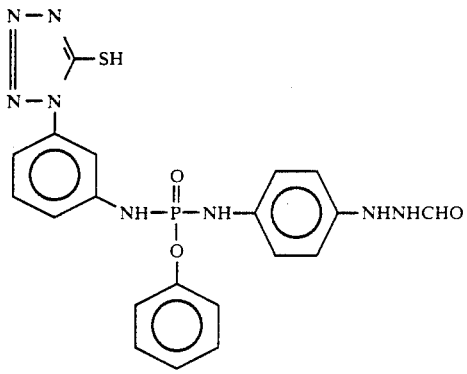

(I-55)

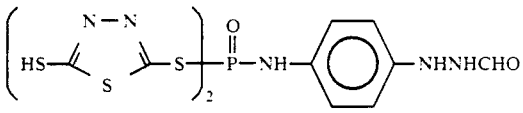

(I-56)

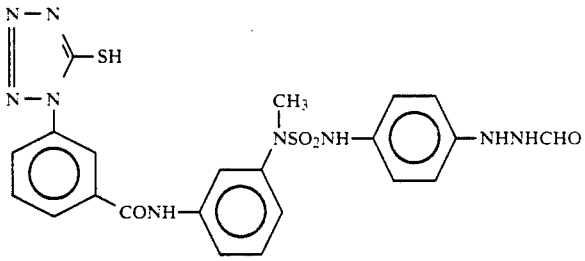

Next, the redox compounds which are capable of releasing a development inhibitor by oxidation, which are employed in the present invention, are explained in detail hereunder.

The redox group moiety of the redox compounds is for example, a hydroquinone, a catechol, a naphthohydroquinone, an aminophenol, a pyrazolidone, a hydrazine, a hydroxylamine or a redactone. The redox group moiety is especially preferably a hydrazine moiety and the compounds of the following formula (II) are most preferred:

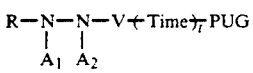

(II)

where $A_1$ and $A_2$ are both hydrogen atoms or one of them is a hydrogen atom and the other is a sulfinic acid group or

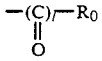

(in which $R_0$ represents an alkyl group, an alkenyl group, an aryl group, an alkoxy group or an aryloxy group; and l represents 1 or 2); Time represents a divalent linking group;

t represents 0 or 1; PUG represents a development inhibitor group;

V represents a carbonyl group,

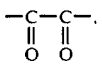

a sulfonyl group, a sulfonyloxy group,

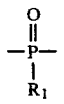

(in which $R_1$ represents an alkoxy group or an aryloxy group), an iminomethylene group or a thiocarbonyl group; and R represents an aliphatic group, an aromatic group or a heterocyclic group.

The compounds of formula (II) are explained in detail hereunder.

In formula (II), $A_1$ and $A_2$ each is a hydrogen atom, an alkylsulfonyl or arylsulfonyl group having 20 or less carbon atoms (preferably, an unsubstituted phenylsulfonyl group, or a substituted phenylsulfonyl group in which the sum of the Hammett's substituent constants is −0.5 or more),

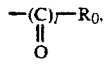

in which $R_0$ is preferably a linear, branched or cyclic alkyl or alkenyl group having 30 or less carbon atoms, an aryl group having up to 30 carbon atoms (preferably, an unsubstituted phenyl group or a substituted phenyl group which is substituted in such a way that the sum of the Hammett's substituent constants is −0.5 or more), an alkoxy group having up to 30 carbon atoms (e.g., ethoxy group) or an aryloxy group having up to 30 carbon atoms (preferably, a monocyclic aryloxy group). These groups may optionally have one or more substituents which may also be further substituted. Examples of such substituents include an alkyl group, an aralkyl group, an alkenyl group, an alkynyl group, an alkoxy group, an aryl group, a substituted amino group, an acylamino group, a sulfonylamino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, a nitro group, an alkylthio group or an arylthio group. Specific examples of the sulfinic acid groups for $A_1$ and $A_2$ are mentioned in U.S. Pat. No. 4,478,928.

$A_1$ may form a ring along with the moiety —(Time)$_t$— as described in further detail below.

$A_1$ and $A_2$ are most preferably both hydrogen atoms.

Time represents a divalent linking group, which may have a time adjusting function. t represents 0 or 1, and when t is 0, PUG is directly bonded to V.

The divalent linking group for Time indicates a group which is capable of releasing PUG from the moiety Time-PUG, which in tern is released from the oxidation product of the redox nucleus, via a one-stage or a multiple-stage reaction.

Examples of the divalent linking group for Time include p-nitro-phenoxy compounds capable of releasing PUG (photographically useful group) by intramolecular ring-closure reaction described in U.S. Pat. No. 4,248,962 (JP-A-54-145135); the compounds capable of releasing PUG by a ring-cleavage reaction followed by the intramolecular ring-closure reaction described in U.S. Pat. No. 4,310,612 (JP-A-55-53330) and U.S. Pat. No. 4,358,525; the succinic acid monoesters or analogues thereof capable of releasing PUG by the intramolecular ring-closure reaction of the carboxyl group along with the formation of an acid anhydride, described in U.S. Pat. Nos. 4,330,617, 4,446,216 and 4,483,919 and JP-A-59-121328; the compounds capable of releasing PUG by electron transfer of an aryloxy or heterocyclic-oxy group via a conjugated double bond to form a quinomonomethane or an analogue thereof, as described in U.S. Pat. Nos. 4,409,232, 4,421,845, *Research Disclosure,* Item No. 21,228 (December, 1981), U.S. Pat. No. 4,416,977 (JP-A-57-135944) and JP-A-58-209736 and JP-A-58-209738; the compounds capable of releasing PUG by electron transfer of an enamine structure moiety of the nitrogen-containing ring from the gamma-position of the enamine, as described in U.S. Pat. No. 4,420,554 (JP-A-57-136640), JP-A-57-135945, JP-A-57-188035, JP-A-58-98728 and JP-A-58-209737; the compounds capable of releasing PUG by an intramolecular ring-closure reaction of the hydroxyl group formed by electron transfer of the carbonyl group conjugated with the nitrogen atom of the nitrogen-containing hetero ring, as described in JP-A-57-56837; the compounds capable of releasing PUG with formation of aldehydes as described in U.S. Pat. No. 4,146,396 (JP-A-52-90932), JP-A-59-93442 and JP-A-59-75475; the compounds capable of releasing PUG with decarbonylation of a carboxyl group, as described in JP-A-51-146828, JP-A-57-179842 and JP-A-59-104641; compounds containing —O—COOC$R_a$R$_b$—PUG (wherein $R_a$ and $R_b$ each is a monovalent group) and capable of releasing PUG by decarbonylation followed by formation of aldehydes; the compounds capable of releasing PUG with formation of isocyanates, as described in JP-A-60-7429; and the compounds capable of releasing PUG by a coupling reaction with the oxidation product of a color developing agent, as described in U.S. Pat. No. 4,438,193.

Specific examples of the divalent linking groups for Time are described in detail in JP-A-61-236549 and Japanese Patent Application No. 63-98803. Preferred examples of the groups are mentioned below, where (*) indicates the position where —(Time)$_t$—PUG is bonded to V in the formula (II) and (*)(*) indicates the position where the group Time is bonded to PUG.

T-(1)

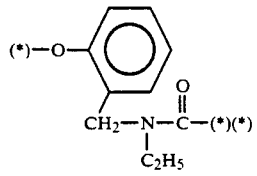

T-(2)

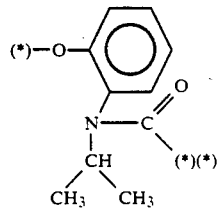

-continued
T-(3)
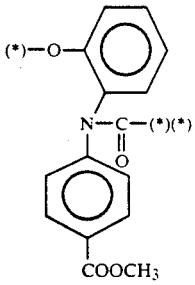
T-(4)
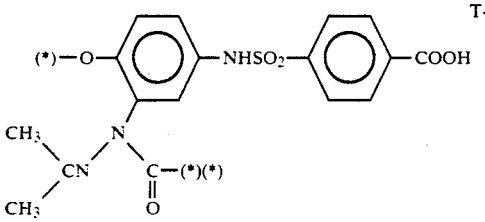
T-(5)
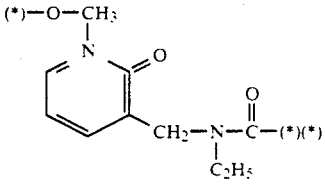
T-(6)
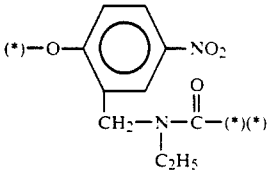
T-(7)
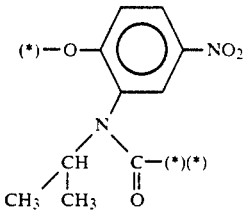
T-(8)
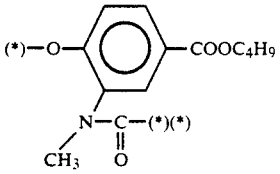
T-(9)
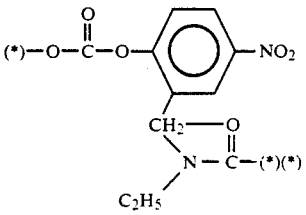
-continued
T-(10)
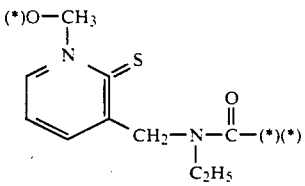
T-(11)
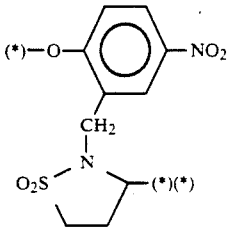
T-(12)
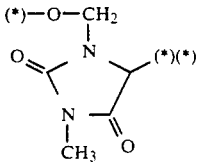
T-(13)
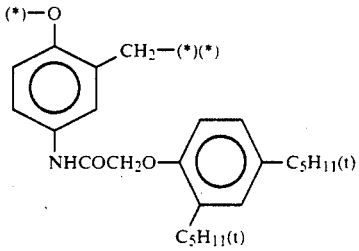
T-(14)
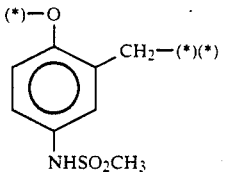
T-(15)
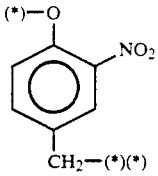
T-(16)
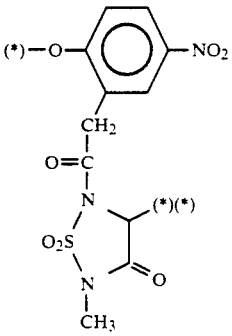

-continued
T-(17)
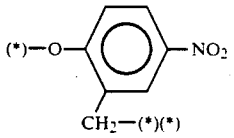
T-(18)
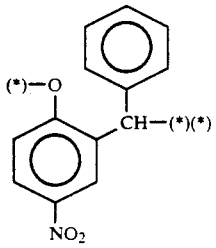
T-(19)
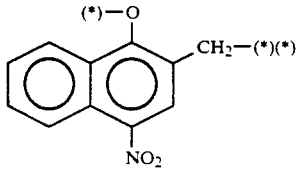
T-(20)
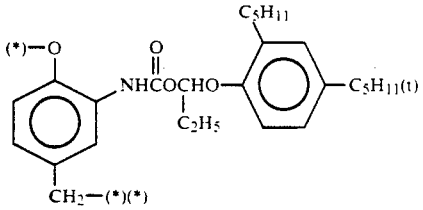
T-(21)
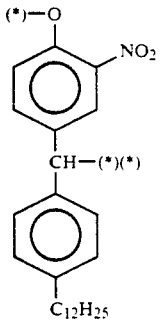
T-(22)
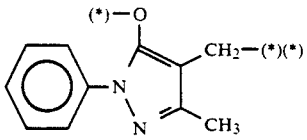
T-(23)
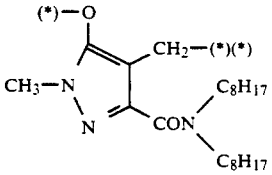
T-(24)
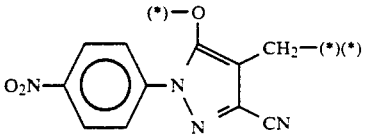
-continued
T-(25)
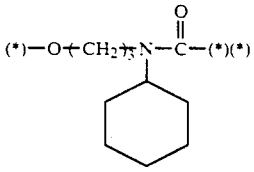
T-(26)
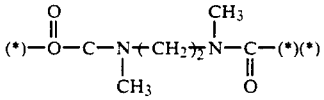
T-(27)
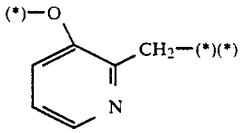
T-(28)
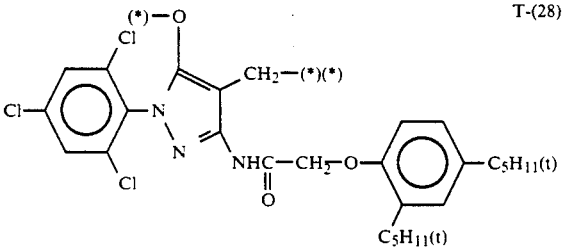
T-(29)
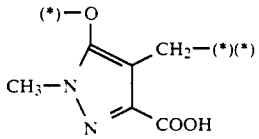
T-(30)
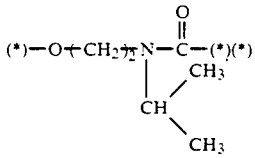
T-(31)
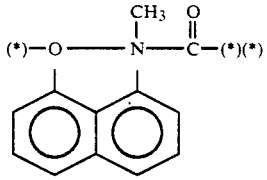
T-(32)
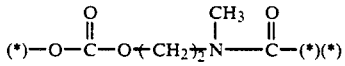
T-(33)
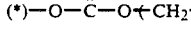
T-(34)
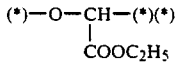
T-(35)
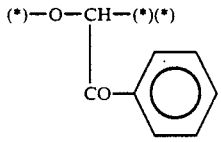

-continued

T-(36)

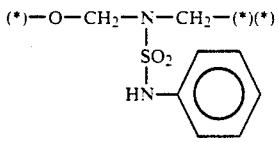

T-(37)

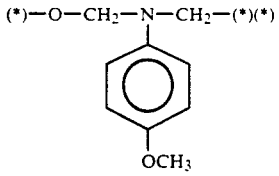

T-(38)

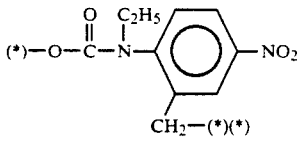

T-(39)

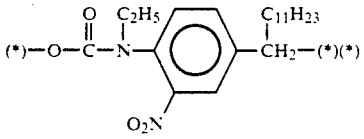

T-(40)

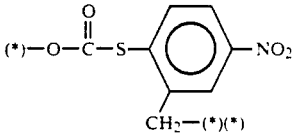

T-(41)

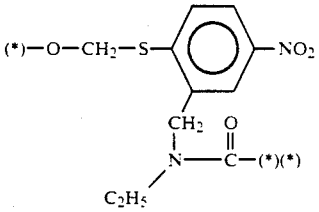

T-(42)

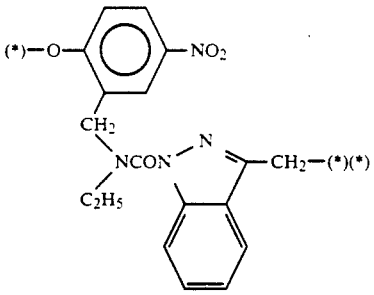

The group PUG means a development inhibitor either, as $(Time)_r$-PUG or PUG.

The development inhibitor represented by PUG or $(Time)_r$-PUG may be a known development inhibitor containing hetero atoms, and it is bonded to Time or V via the hetero atom. Examples of such development inhibitors are described, for example, in C. E. M. Mess and T. H. James, *The Theory of Photographic Processes,* 3rd Ed. (published by Macmillan Co.), pages 344 to 346. Specifically, they include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetrazaindenes, triazaindenes and mercaptoaryls.

The development inhibitor represented by PUG may optionally be substituted. Examples of such substituents, include the following groups, which may further be substituted: an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosfinyl group or a phosphoric acid amido group. Preferred substituents are a nitro group, a sulfo group, a carboxyl group, a sulfamoyl group, a phosphono group, a phosfinyl group and a sulfonamido group.

Specific examples of suitable development inhibitors are mentioned below;

1. Mercaptotetrazole Compounds (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole Hydrochloride
(32) 1-(2-Diethylaminoethyl)-5-mercaptotetrazole
(33) 2-(5-Mercapto-1-tetrazolyl)ethyltrimethylammonium Chloride
(34) 1-(3-Phenoxycarbonylphenyl)-5-mercaptotetrazole
(35) 1-(3-Maleimidophenyl)-5-mercaptotetrazole 2. Mercaptotriazole Compounds (1) 4-Phenyl-3-mecaptotriazole (2) 4-Phenyl-5-methyl-3-mercaptotriazole
(3) 4,5-Diphenyl-3-mecaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Compounds (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptooyrimidine Compounds (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Compounds (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Compounds (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole Compounds (1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Compounds (1) 2-Mercaptobenzoxazole
(2) 5-Nitro-2-mecaptobenzoxazole
(3) 5-Carboxy-2-mercaptobenzoxazole
(4) 5-Sulfo-2-mercaptobenzothiazole 9. Benzotriazole Compounds (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chloro-benzotriazole
(10) 4,5,6-Trichlorobenzotriazole
(11) 5-Carboxybenzotriazole
(12) 5-Sulfobenzotriazole Sodium Salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Compounds (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Compounds (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole Compounds (1) 5-(4-Nitrophenyl)-tetrazole
(2) 5-Phenyltetrazole
(3) 5-(3-Carboxyphenyl)-tetrazole 13. Tetrazaindene Compounds (1) 4-Hydroxy-6-methyl-5-nitro-1,3,3a,7-tetrazaindene
(2) 4-Mercapto-6-methyl-5-nitro-1,3,3a,7-tetrazaindene 14. Mercaptoaryl Compounds (1) 4-Nitrothiophenol
(2) Thiophenol
(3) 2-Carboxythiophenol V represents a carbonyl group, $$-\underset{\underset{O}{\|}}{C}-\underset{\underset{O}{\|}}{C}-,$$

a sulfonyl group, a sulfoxy group, $$-\overset{\overset{O}{\|}}{\underset{\underset{R_1}{|}}{P}}-$$

(in which $R_1$ represents an alkoxy group or an aryloxy group), an iminomethylene group or a thiocarbonyl group. Preferably, V is a carbonyl group.

The aliphatic group represented by R may be a linear, branched or cyclic alkyl, alkenyl or alkynyl group, preferably having 1 to 30 carbon atoms, especially 1 to 20 carbon atoms. The branched alkyl group may be cyclized to form a saturated hetero ring containing one or more hetero atoms therein.

For instance, there are mentioned a methyl group, a t-butyl group, an n-octyl group, a t-octyl group, a cyclohexyl group, a hexenyl group, a pyrrolidyl group, a tetrahydrofuryl group and an n-dodecyl group.

The aromatic group represented by R may be a monocyclic or bicyclic aryl group, which includes, for example, a phenyl group and a naphthyl group.

The heterocyclic group represented by R may be a 3-membered to 10-membered saturated or unsaturated heterocyclic group containing at least one N, O or S atom, which may be monocyclic or may also form a condensed ring together with other aromatic ring(s) and/or hetero ring(s). The heterocyclic group is preferably a 5-membered or 6-membered aromatic heterocyclic group, which includes, for example, a pyridine ring, an imidazolyl group, a quinolinyl group, a benzimidazolyl group, a pyrimidinyl group, a pyrazolyl group, an isoquinolinyl group, a benzothiazolyl group and a thiazolyl group.

The R group may optionally be substituted by one or more substituents. Examples of the substituents include the following groups, which may optionally be further substituted: an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group and a phosphoric acid amido group.

In formula (II), the group R or -(Time)$_r$-PUG may contain a ballast group which is commonly included immobile photographic additives such as couplers or a group having a function of accelerating adsorption of the compound of the formula (II) to silver halide grains, if desired.

The ballast group suitable for the purpose is an organic group which may give a sufficient molecular weight to the compound of formula (II) so that the compound would not substantially diffuse into the other layers or into the processing solution. It is composed of one or more of an alkyl group, an aryl group, a heterocyclic group, an ether group, a thioether group, an amido group, a ureido group, a urethane group and a sulfonamido group. Preferably, the ballast group is a substituted benzene ring-containing ballast group, especially a branched alkyl group-substituted benzene ring-containing ballast group.

Examples of the group having the function of accelerating adsorption of the compound of the formula (II) to silver halides include: cyclic thioamido groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidazoline-2-thione; linear thioamido groups; aliphatic mercapto groups; aromatic mercapto groups; heterocyclic mercapto groups (when a nitrogen atom is adjacent to the carbon atom bonded to -SH, the groups are essentially the same as the cyclic thioamido groups which are tautomers of these mercapto groups, and specific examples of these groups are the corresponding groups of those mentioned above in connection with cyclic thioamido groups); disulfide bond-containing groups; 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazolines, oxazoles, oxazolines, thiadiazoles, oxathiazoles, triazines, azaindenes; and heterocyclic quaternary salts such as benzimidazoliums.

These groups may further be substituted by appropriate substituent(s), if desired.

Examples of the substituents include those mentioned above for the R group.

Specific examples of the compounds of the formula (II) which are employable in the present invention are mentioned below, but they do not limit the scope of the invention.

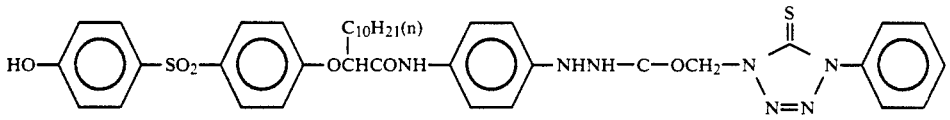

II-1

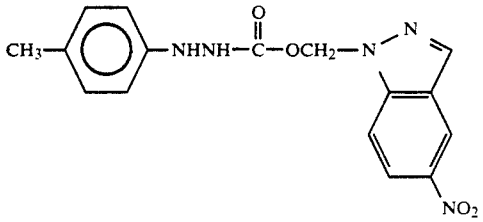

II-2

-continued
II-3
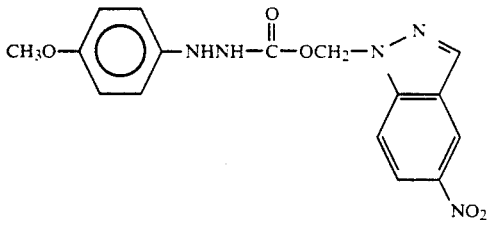
II-4
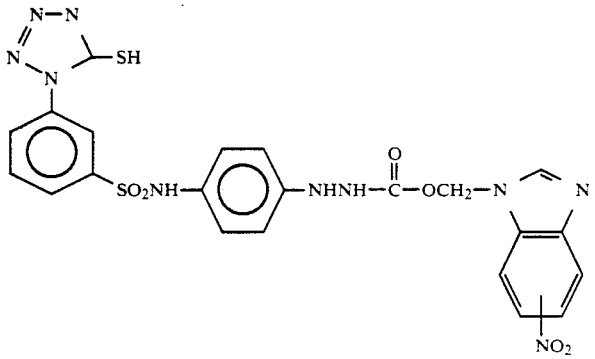
II-5
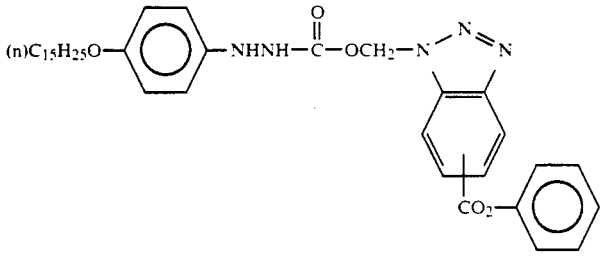
II-6
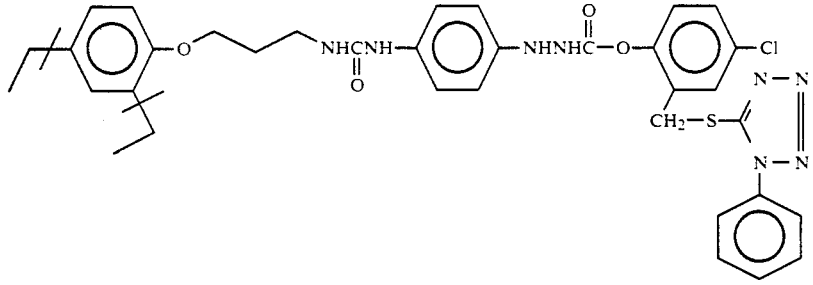
II-7
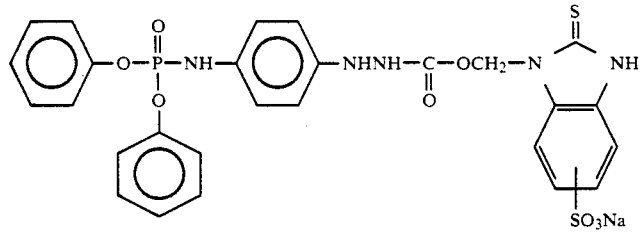
II-8
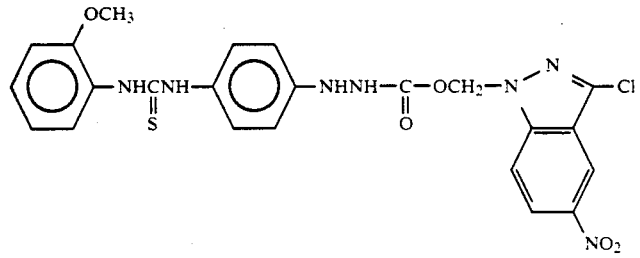

-continued
II-9
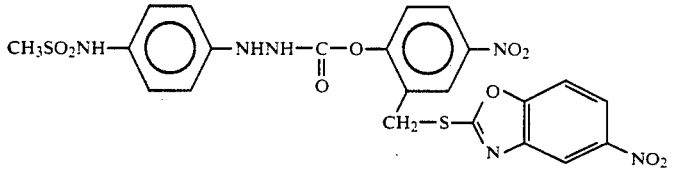
II-10
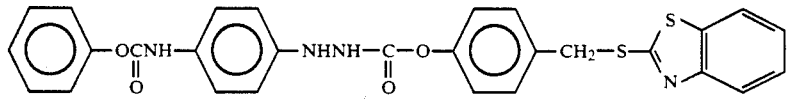
II-11
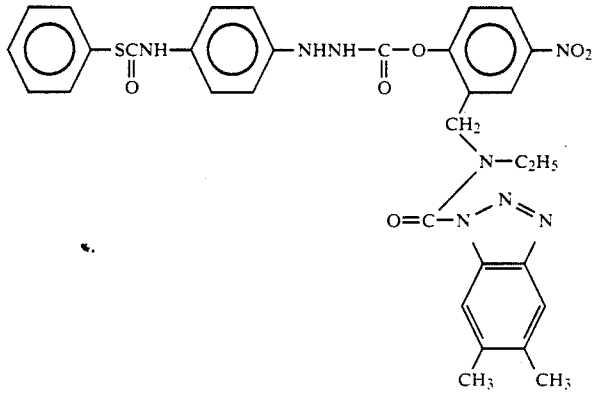
II-12
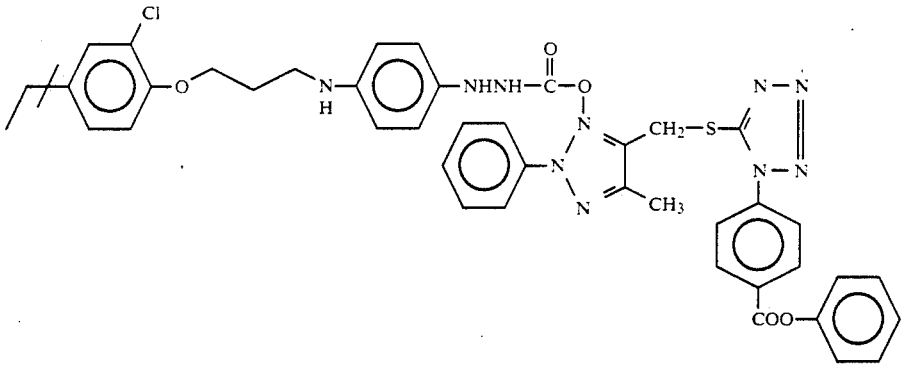
II-13
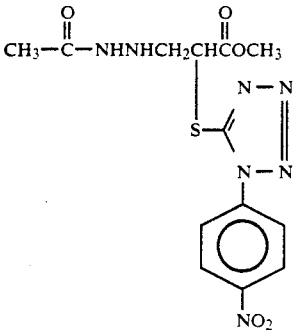

-continued
II-14
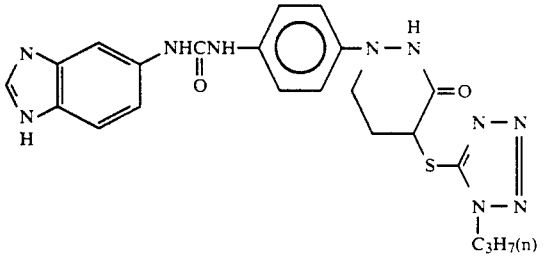
II-15
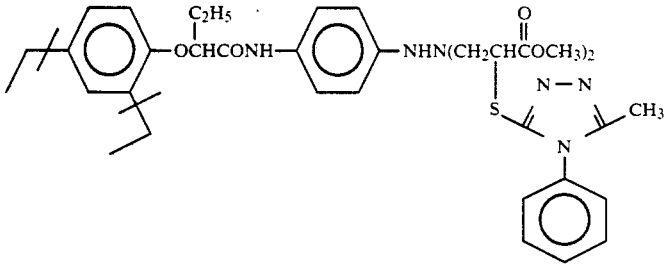
II-16
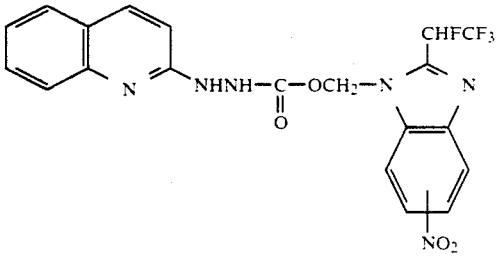
II-17
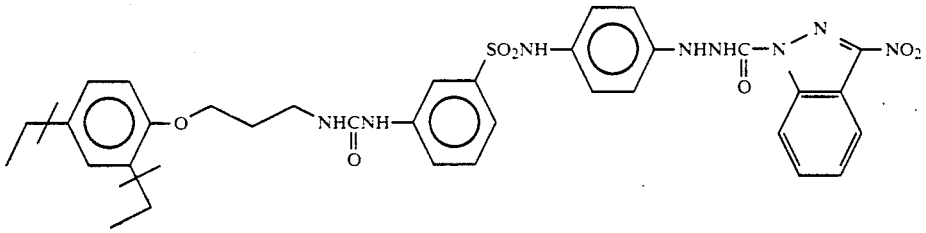
II-18
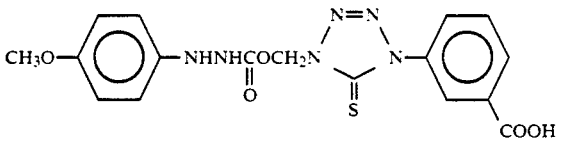
II-19
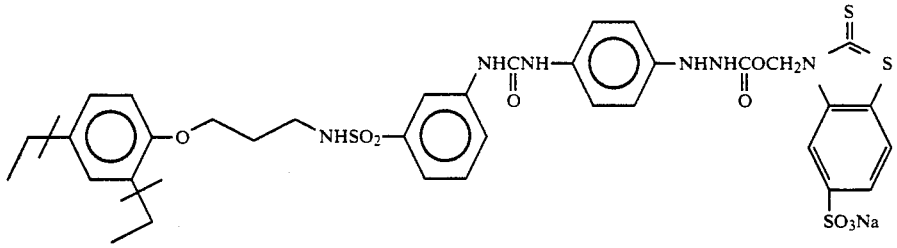
II-20
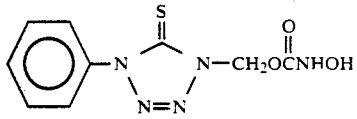

-continued
II-21
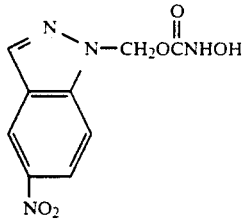
II-22
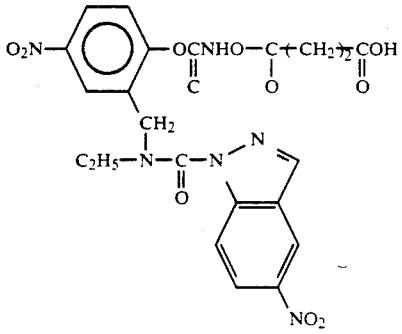
II-23
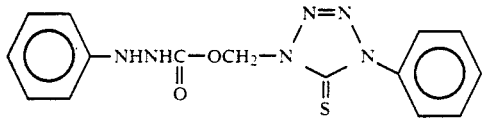
II-24
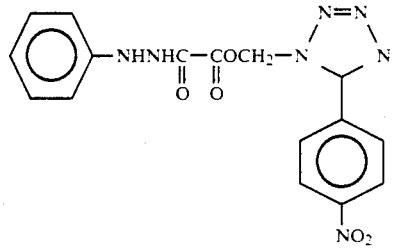
II-25
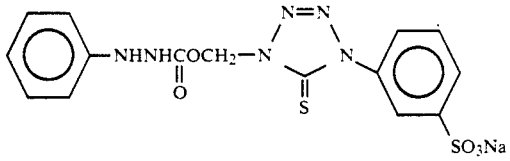
II-26
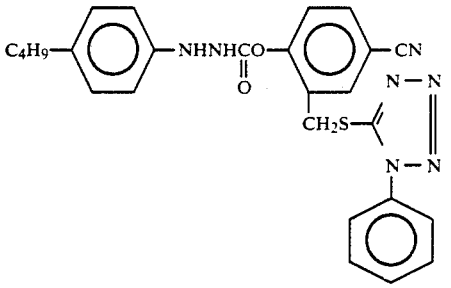
II-27
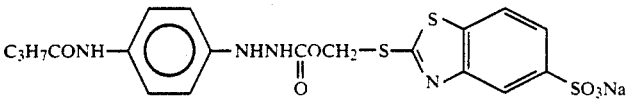

-continued
II-28
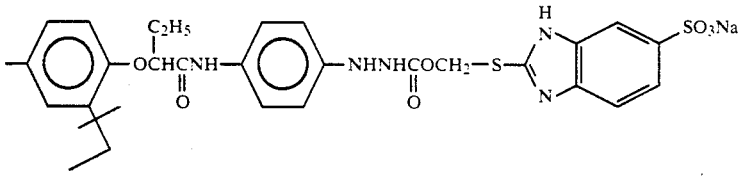
II-29
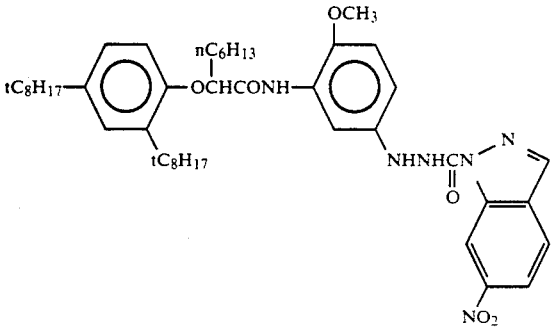
II-30
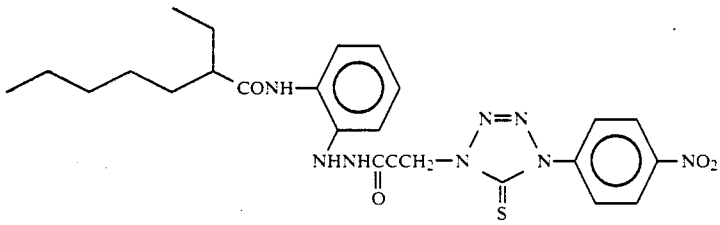
II-31
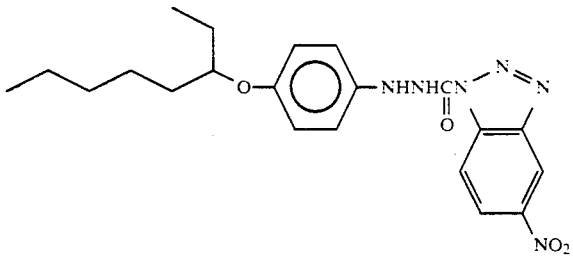
II-32
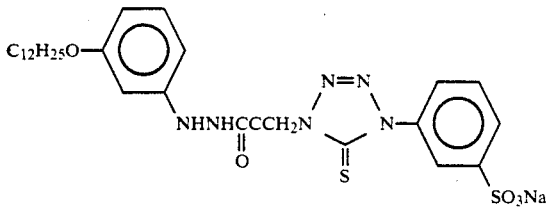
II-33
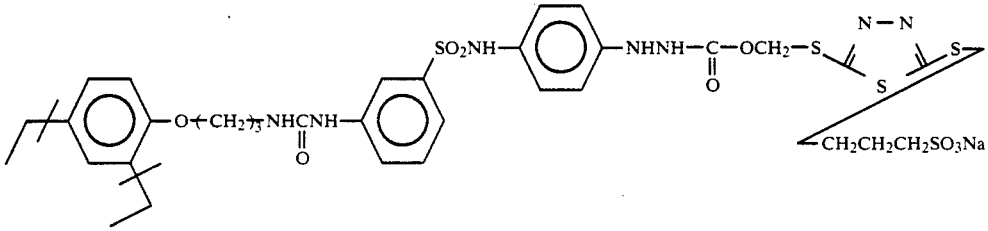

-continued
II-34
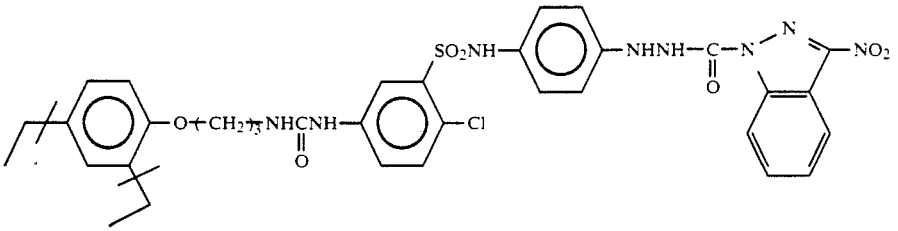
II-35
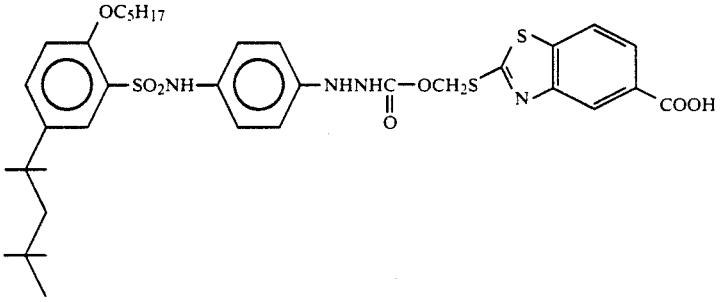
II-36
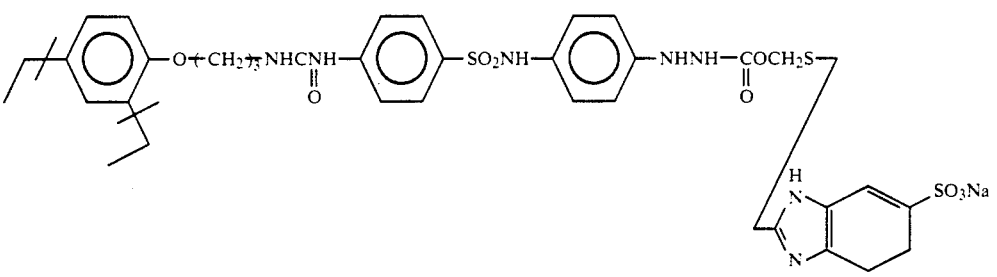
II-37
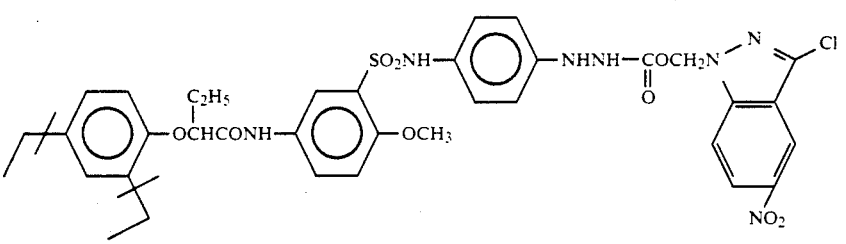
II-38
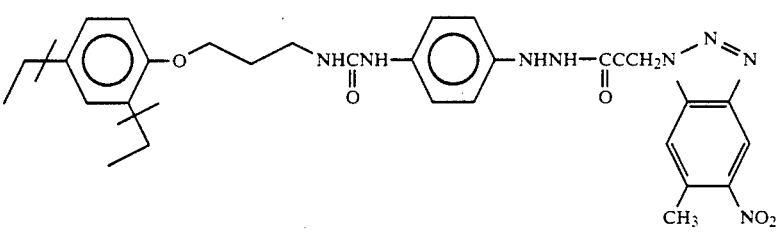
II-39
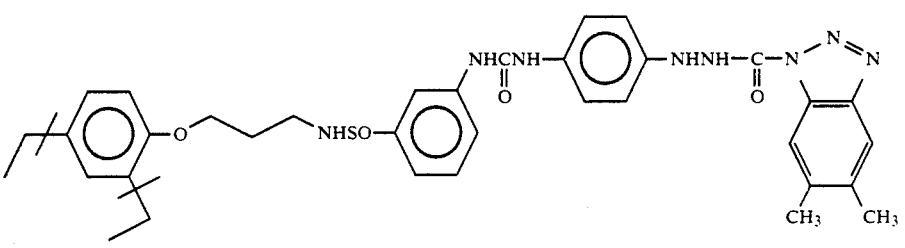

-continued
II-40
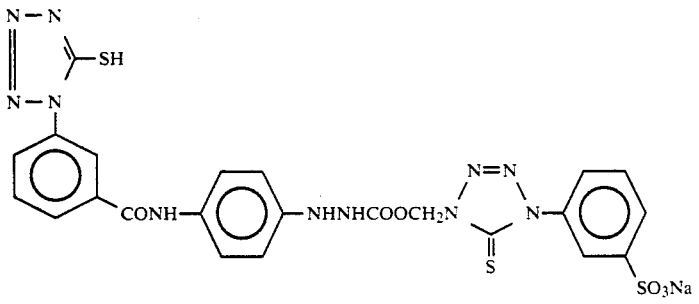
II-41
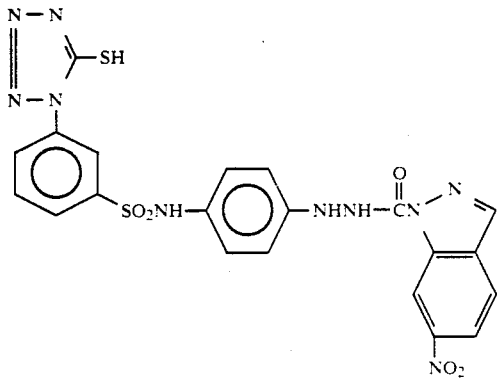
II-42
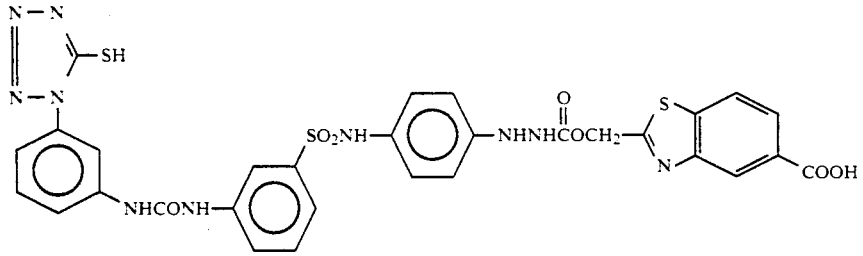
II-43
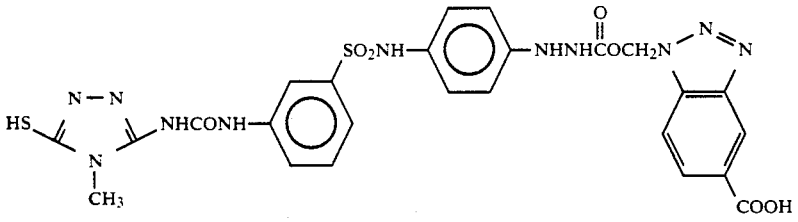
II-44
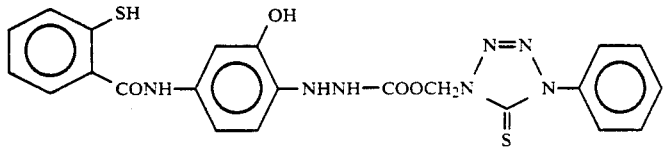

-continued
II-45
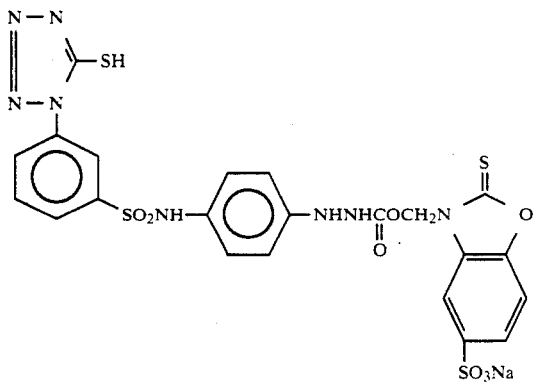
II-46
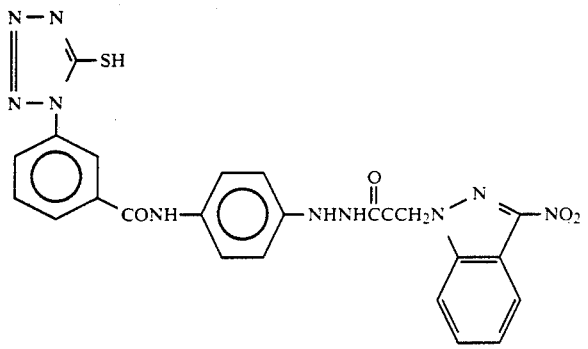
II-47
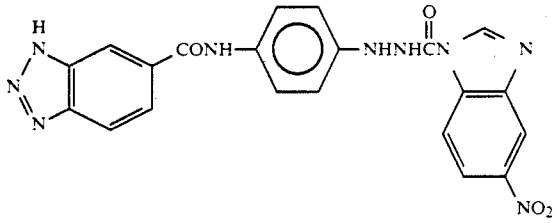
II-48
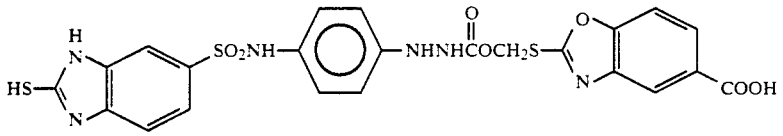
II-49
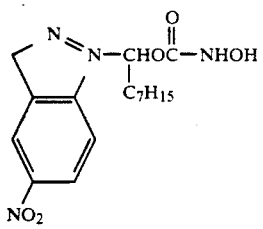
II-50
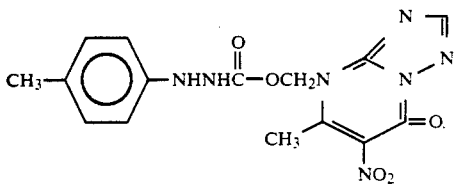

-continued
II-51
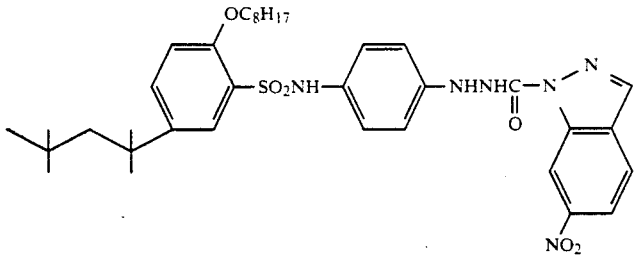
II-52
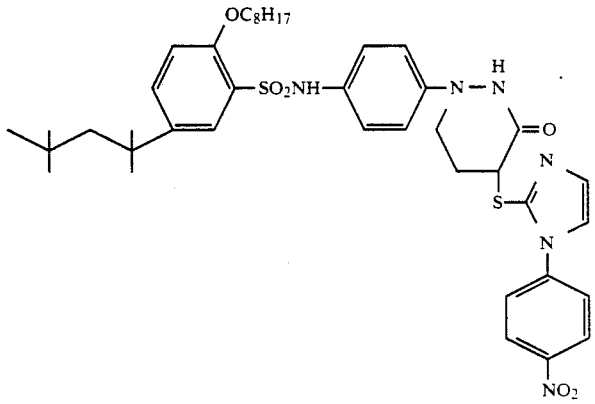
II-53
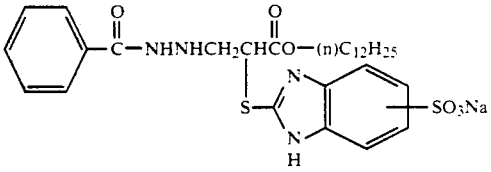
II-54
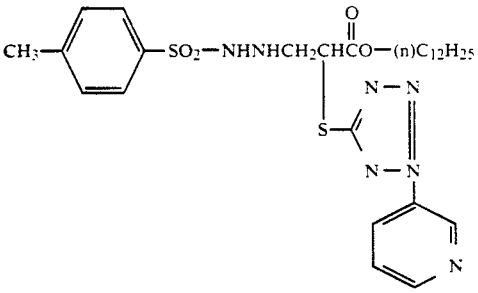
II-55
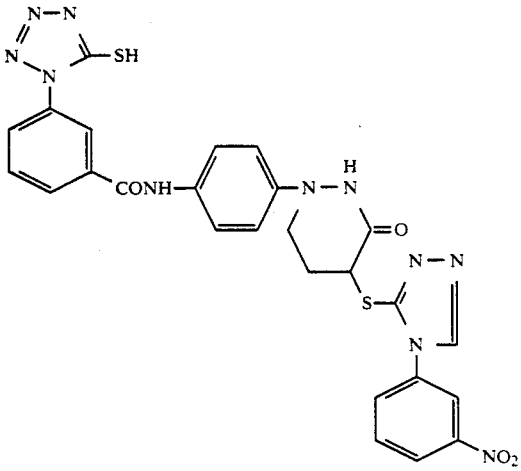

-continued
II-56
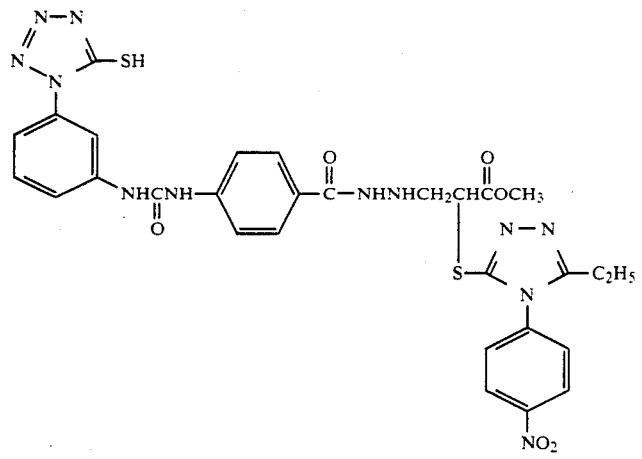
II-57
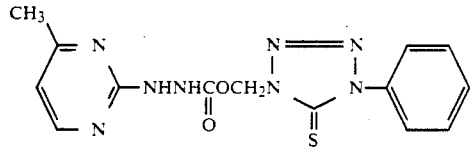
II-58
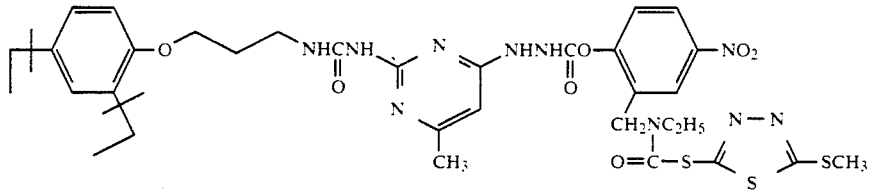
II-59
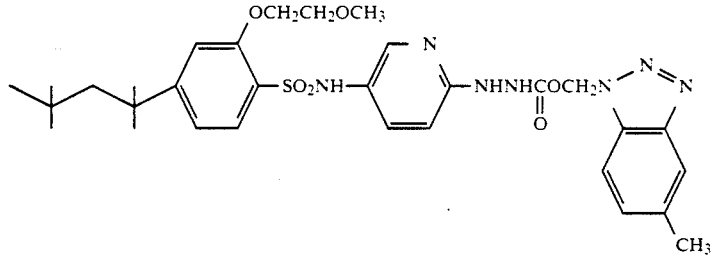
II-60
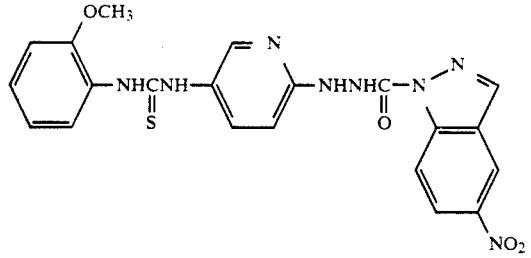
II-61
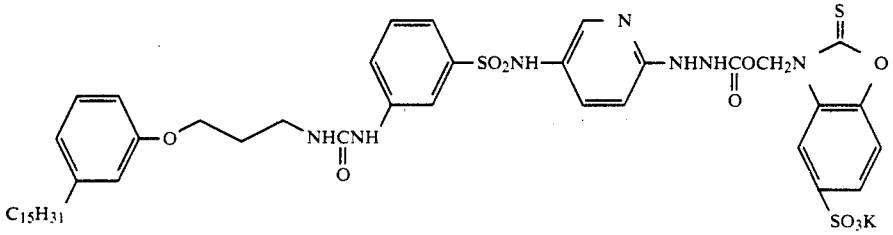

-continued

II-62

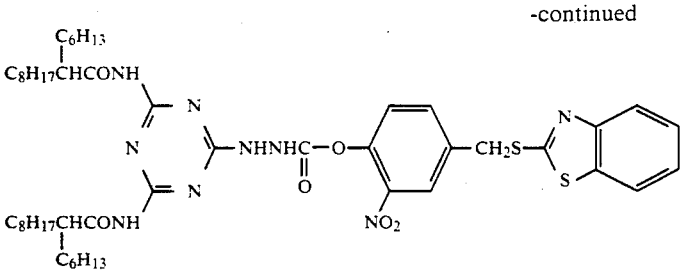

II-63

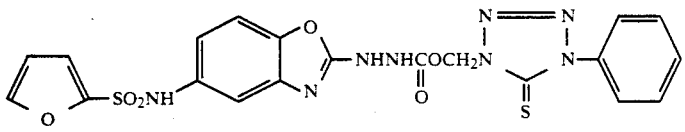

II-64

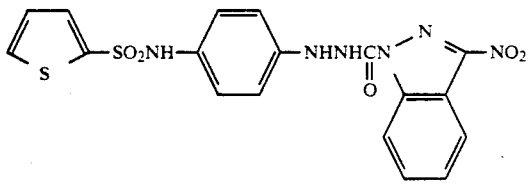

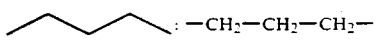

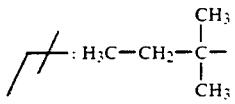

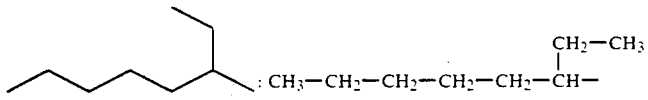

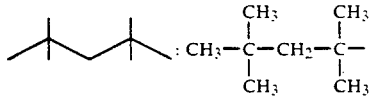

The redox compounds for use in the present invention can be produced in accordance with the methods described in, for example, JP-A-61-213847, JP-A-62-260153, U.S. Pat. No. 4,684,604, Japanese Patent Application No. 63-98803, U.S. Pat. Nos. 3,379,529, 3,620,746, 4,377,634, 4,332,878, JP-A-49-129536, JP-A-56-153336 and JP-A-56-153342.

The redox compound of the invention is incorporated into the photographic material in an amount of $1\times10^{-5}$ to $5\times10^{-2}$ mol, more preferably $2\times10^{-5}$ to $1\times10^{-2}$ mol, per mol of the silver halide in the material. The redox compound of the invention may be dissolved in an appropriate water-miscible organic solvent, for example, an alcohol (e.g., methanol, ethanol, propanol, a fluoroalcohol), a ketone (e.g., acetone, methyl ethyl ketone), dimethylformamide, dimethylsulfoxide or methylcellosolve, and the resulting solution may be incorporated into the coating composition.

Alternatively, the redox compound may be dispersed in an oil such as dibutyl phthalate, tricresyl phosphate, glyceryl triacetate or diethyl phthalate in the presence of an auxiliary solvent such as ethyl acetate or cyclohexanone by a well known emulsification and dispersion method to mechanically form an emulsified dispersion of the redox compound. The resulting dispersion may be incorporated into the coating composition.

In addition to the above technique, a powder of the redox compound may also be dispersed in water by the use of a ball mill or colloid mill or ultrasonically in accordance with a method which is known as a solid dispersion method, and the resulting dispersion may be incorporated into the coating composition.

When the compounds of formula (I), and the redox compounds such as those of formula (II) of the invention are incorporated into the photographic emulsion layer or the hydrophilic colloid layer of the photographic material, they are first dissolved in water or in a water-miscible organic solvent whereupon an alkali hydroxide or a tertiary amine may be added thereto and the resulting salt is dissolved in the solvent, if desired, and thereafter the resulting solution may be added to the hydrophilic colloid liquid (for example, silver halide emulsion or aqueous gelatin solution) whereupon the pH value of the blend system may optionally be adjusted by the addition of an acid or alkali thereto.

The compound of the formula (I) may be employed singly or in combination of two or more. The amount of the compound(s) of formula(I) to be added to the photographic material of the invention is from $1\times10^{-6}$ to $5\times10^{-2}$ mol, more preferably from $1\times10^{-5}$ to $1\times10^{-2}$ mol, per mol of the silver halide in the material. It may properly be selected in accordance with the properties of the silver halide emulsion to be combined with the compound(s) of formula (I).

By combining the compounds of formulae (I) and (II) of the invention in a negative emulsion, a negative image having a high contrast can be formed. Additionally, the compounds of the invention may be combined with an internal latent image-type silver halide emulsion. However, it is preferred that the compounds of the formulae (I) and (II) of the invention are combined with a negative emulsion for forming a hard negative image having a high contrast.

Where the compounds of the invention are utilized for forming a negative image having a high contrast, the silver halide grains to be employed are preferably fine grains having a mean grain size of, for example, 0.7 μm or less, especially 0.5 μm or less. Although the molecular size distribution of the silver halide grains is not specifically limited, the emulsion is preferably a monodispersed emulsion. The "monodispersed emulsion" as referred to herein means that at least 95% by number or by weight of the silver halide grains in the emulsion have a grain size falling within the range of the mean grain size plus/minus 40%.

The silver halide grains in the photographic emulsion may be regular crystals such as cubic, octahedral, rhombic dodecahedral or tetradecahedral crystals, or may be irregular crystals such as spherical or tabular crystals, or composite crystals composed of these various crystal forms.

The silver halide grains may have a uniform phase throughout the whole grain or may have different phases in the inside of the grain and the surface layer thereof.

The silver halide grains in the emulsion for use in the present invention may be formed or physically ripened in the presence of a cadmium salt, a sulfite, a lead salt, a thallium salt, a rhodium salt or a complex salt thereof, or an iridium salt or a complex salt thereof.

Specifically, the silver halide grains for use in the present invention preferably are prepared in the presence of an iridium salt or a complex salt thereof in an amount of $10^{-8}$ to $10^{-5}$ mol per mol of silver, and they are silver haloiodides where the silver iodide content on the surface of the grain is larger than the mean silver iodide content in the whole grain.

The silver halide emulsion to be employed in the present invention may be or may not be chemically sensitized. As the means of chemical sensitization of silver halide grains, sulfur sensitization, reduction sensitization and noble metal sensitization are known. Any of them can be employed singly or in combination of two or more for chemical sensitization of the emulsion of the invention.

It is preferred to use an iridium salt or a rhodium salt before completion of physical ripening of the silver halide emulsion, especially during formation of the silver halide grains.

In the present invention, it is preferred that the silver halide emulsion layer contains two monodispersed emulsions each having a different mean grain size, whereby the maximum density (Dmax) is elevated. Of the two emulsions, the small-sized monodispersed grains are preferably chemically sensitized, most preferably by sulfur sensitization. The other large-sized monodispersed grains may be or may not be chemically sensitized. Since the large-sized monodispersed grains often cause generation of black pepper and they are thereof not generally chemically sensitized. However, if they are chemically sensitized, it is especially desired that the chemical sensitization is lightly effected so that it does not cause generation of black pepper.

The mean grain size of the small-sized monodispersed grains is 90% or less than that of the large-sized monodispersed grains and is preferably 80% or less thereof. The mean grain size of the silver halide grains for use in the present invention is preferably from 0.02 μm to 1.0 μm, more preferably from 0.1 μm to 0.5 μm. It is more preferred that the mean grain sizes of both the large-sized grains and the small-sized grains are within the above range.

The total amount of silver coated is preferably from 1 $g/m^2$ to 8 $g/m^2$.

The photographic materials of the present invention can contain various sensitizing dyes, for example, those described in JP-A-55-52050, pages 45 to 53 (such as cyanine dyes or merocyanine dyes), for the purpose of elevating the sensitivity thereof. These sensitizing dyes may be added to the photographic material singly or in combination of two or more. The combination of sensitizing dyes is often employed for the purpose of super color sensitization. Additionally, dyes which do not have a color-sensitizing effect by themselves or substances which do not substantially absorb visible rays but have a super color-sensitizing capacity may also be incorporated into the emulsion of the photographic material of the invention, along with the sensitizing dyes. Appropriate sensitizing dyes, combinations of dyes for super color-sensitization and super color-sensitizing substances are described in *Research Disclosure,* Vol. 176, Item No. 17643 (December, 1978), page 23, IV-J.

The photographic materials of the present invention can contain various compounds for the purpose of preventing the materials from fogging during manufacture, storage or photographic processing thereof or for the purpose of stabilizing the photographic properties of the materials. For the purposes benzotriazoles (for example, 5-methyl-benzotriazole) and nitroindazoles (for example, 5-nitroindazole) are preferred. The compounds may be added to the processing solutions.

The development accelerator or accelerator for nucleating infectious development which is suitably employed in the present invention, include the compounds illustrated in JP-A-53-77616, JP-A-54-37732, JP-A-53-137133, JP-A-60-140340 and JP-A-60-14959, as well as various other compounds containing nitrogen and/or sulfur atom(s).

The optimum amount of the accelerator to be applied to the photographic materials of the present invention is, although varying in accordance with the type compound of agent, desirably from $1.0\times10^{-3}$ to 0.5 $g/m^2$, preferably from $5.0\times10^{-3}$ to 0.1 $g/m^2$.

The photographic materials of the present invention can contain a desensitizing agent in the photographic emulsion layer or in any other hydrophilic colloid layers.

The desensitizing agent for use in the present invention may be an organic desensitizing agent, which is defined by the polarographic half-wave potential or by the oxidation-reduction potential to be determined by polarography. That is, the desensitizing agent is defined so that the sum of the polarographic anode potential and the polarographic cathode potential is positive.

The preferred organic desensitizing agents for use in the present invention are those represented by formulae (III) to (V) described in JP-A-63-141608.

In accordance with the present invention, the organic desensitizing agent is preferably incorporated into the silver halide emulsion layer in an amount of from $1.0\times10^{-8}$ to $1.0\times10^{-4}$ mol/m$^2$, especially from $1.0\times10^{-7}$ to $1.0\times10^{-5}$ mol/m$^2$.

The photographic materials of the present invention can contain water-soluble dyes in the emulsion layer or in any other hydrophilic colloid layers, as a filter dye or for the purpose of anti-irradiation or for any other purpose. The filter dyes are those having the function of further lowering the photographic sensitivity of the photographic materials. They are preferably ultraviolet absorbents having a spectral absorption maximum in the intrinsic sensitivity range of the silver halides in the materials, or dyes which have a substantial light absorption in the range of essentially from 380 nm to 600 nm for the purpose of elevating safety to safelight when the material are handled under daylight conditions.

The dyes are added to the emulsion layer or to a layer above the silver halide emulsion layer or a non-light-sensitive hydrophilic colloid layer which is more remote from the support than the silver halide emulsion layer and are preferably fixed to the layer along with a mordant agent, in accordance with the object.

The ultraviolet absorbents are added to the photographic materials generally in an amount of from $10^{-2}$ g/m$^2$ to 1 g/m$^2$, preferably from 50 mg/m$^2$ to 500 mg/m$^2$, though varying in accordance with the molar extinction coefficient thereof.

The ultraviolet absorbents may be dissolved in an appropriate solvent (for example, water, an alcohol (e.g., methanol, ethanol or propanol), acetone, methyl cellosolve or mixed solvents thereof) and the resulting solution may be added to the coating composition.

The ultraviolet absorbents usable in the present invention include aryl group-substituted benzotriazole compounds, 4-thiazolidone compounds, benzophenone compounds, cinnamic acid ester compounds, butadiene compounds, benzoxazole compounds and ultraviolet-absorbing polymers.

Specific examples of the usable ultraviolet absorbents are described, for example, in U.S. Pat. Nos. 3,533,794, 3,314,794, 3,352,681, JP-A-46-2784, U.S. Pat. Nos. 3,705,805, 3,707,375, 4,045,229, 3,700,455 and 3,499,762 and West German Patent OLS No. 1,547,863.

The filter dyes usable in the present invention include oxonole dyes, hemioxonole dyes, styryl dyes, merocyanine dyes, cyanine dyes and azo dyes. For the purpose of decreasing the residual color in the photographic materials as developed, water-soluble dyes or dyes which may be decolored by alkali substances or sulfite ion are preferred as the filter dyes.

Specific examples of such filter dyes, include the pyrazoloneoxonole dyes described in U.S. Pat. No. 2,274,782; the diarylazo dyes described in U.S. Pat. No. 2,956,879; the styryl dyes or butadienyl dyes described in U.S. Pat. Nos. 3,423,207 and 3,384,487; the merocyanine dyes described in U.S. Pat. No. 2,527,583; the merocyanine dyes or oxonole dyes described in U.S. Pat. Nos. 3,486,897, 3,652,284 and 3,718,472; the enaminohemioxonole dyes described in U.S. Pat. No. 3,976,661; and the dyes described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The filter dyes are dissolved in an appropriate solvent (for example, water, an alcohol (e.g., methanol, ethanol or propanol), acetone, methyl cellosolve or mixed solvents thereof), and the resulting solution may be added to the coating composition for forming the non-light-sensitive hydrophilic colloid layer in the photographic materials of the present invention.

The preferred amount of the filter dyes to be incorporated into the layer may be from $10^{-3}$ g/m$^2$ to 1 g/m$^2$, especially from $10^{-3}$ g/m$^2$ to 0.5 g/m$^2$.

The photographic materials of the present invention may contain an inorganic or organic hardening agent in the photographic emulsion layer or in any other hydrophilic colloid layer. For instance, chromium salts, aldehydes (e.g., formaldehyde, glutaraldehyde), N-methylol compounds (e.g., dimethylolurea), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine) and mucohalogenic acids can be employed singly or in combination of two or more of them, as the hardening agent.

The photographic materials of the present invention can further contain various surfactants in the photographic emulsion layer or in any other hydrophilic colloid layer for various purposes, such as coating assistance, prevention of static charge, improvement of slide property, emulsification and dispersion, prevention of surface blocking and improvement of photographic characteristics (for example, acceleration of developability, elevation of contrast and enhancement of sensitivity). Surfactants which are especially preferably employed in the present invention are polyalkylene oxides having a molecular weight of 600 or more, such as those described in JP-B-58-9412. (The term "JP-B" as used herein means an "examined published Japanese patent publication".) Where the surfactants are employed as an antistatic agent, fluorine-containing surfactants (which are described in detail in U.S. Pat. No. 4,201,586 and JP-A-60-80849 and JP-A-59-74554) are especially preferred.

The photographic materials of the present invention may contain a matting agent such as silica, magnesium oxide or polymethyl methacrylate in the photographic emulsion layer or in any other hydrophilic colloid layer for the purpose of preventing surface blocking.

Additionally, the photographic materials of the present invention may contain a dispersion of a water-insoluble or hardly water-soluble synthetic polymer in the photographic emulsion for the purpose of improving dimensional stability. For instance, polymers or copolymers composed of monomers of alkyl (meth) acrylates, alkoxyalkyl (meth)acrylates and/or glyciyl (meth)acrylates, singly or in combination thereof, optionally along with other comonomers of acrylic acids and/or methacrylic acids may be employed for the purpose.

The photographic materials of the present invention preferably contain an acid group-containing compound in the silver halide emulsion layer or in any other layer. The acid group-containing compounds usable for the purpose include organic acids such as salicylic acid, acetic acid or ascorbic acid as well as polymers or copolymers composed of acid monomers such as acrylic acid, maleic acid or phthalic acid as the repeating unit. Descriptions of suitable compounds are contained in JP-A-61-223834, JP-A-61-228437, JP-A-62-25745 and JP-A-62-55642. Among the compounds, ascorbic acid is especially preferred as one example of a low molecular weight compound, and a water-dispersed latex of a copolymer composed of an acid monomer such as acrylic acid and a crosslinking monomer having two or more unsaturated groups such as divinylbenzene is preferred as an example of a high molecular weight compound.

For obtaining ultra-hard photographic images having a photographic characteristic of high sensitivity by processing the silver halide photographic materials of the present invention, the known infectious developers or the high-alkali developers having a pH value of nearly 13 as described in U.S. Pat. No. 2,419,975 are not necessary. Rather, any stable developer can be used.

Specifically, the silver halide photographic materials of the present invention may well be processed with a developer containing a sulfite ion as a preservative in an amount of 0.15 mol/liter or more and having a pH value of from 10.5 to 12.3, especially from 11.0 to 12.0, whereby ultra-hard negative images can be obtained.

The developing agent to be contained in the developer which is used for processing the photographic materials of the present invention is not specifically limited, but it is desirable that the developer contain dihydroxybenzenes for the purpose of easily obtaining a good dot image quality. As the case may be, a combination of dihydroxybenzenes and 1-phenyl-3-pyrazolidones or a combination of dihydroxybenzenes and p-aminophenols may also be employed. In general, the developer preferably contains the developing agent in an amount of 0.05 mol/liter to 0.8 mol/liter. Where a combination of dihydroxybenzenes and 1-phenyl-3-pyrazolidones or p-aminophenols is employed, the amount of the former is preferably from 0.05 mol/liter to 0.5 mol/liter and that of the latter is from 0.06 mol/liter or less.

The sulfite preservatives which can be used in the present invention include sodium sulfite, potassium sulfite, lithium sulfite, ammonium sulfite, sodium bisulfite, potassium metabisulfite and formaldehydesodium metabisulfite. The concentration of the sulfite is preferably 0.4 mol/liter or more, especially 0.5 mol/liter or more.

The developer to be employed in the present invention can contain the compounds described in JP-A-56-24347 as a silver-stain inhibitor. The developer may further contain a solubilizing aid, which may be selected from the compounds described in JP-A-61-267759.

The developer may also contain a pH buffer, which may be selected from the compounds described in JP-A-60-93433 or the compounds described in JP-A-62-186259.

The following examples are intended to illustrate the present invention in more detail but not to limit it in any way.

EXAMPLE 1

Preparation of Light-Sensitive Emulsion

An aqueous solution of silver nitrate and an aqueous solution of potassium iodide and potassium bromide were simultaneously added to an aqueous gelatin solution kept at 50° C. in the presence of $4\times10^{-7}$ mol per mol of silver of potassium iridium(III) hexachloride and ammonia over a period of 60 minutes, whereupon the pAg value of the reaction system was kept at 7.8. Accordingly, a cubic monodispersed emulsion having a mean grain size of 0.28 μm and a mean silver iodide content of 0.3 mol % was prepared. The emulsion was desalted by flocculation, and an inert gelatin was added thereto in an amount of 40 g per mol of silver. Next, this emulsion was added to a KI solution of 50° C. containing a sensitizing dye of 5,5'-dichloro-9-ethyl-3,3'-bis(3-sulfopropyl)oxacarbocyanine in an amount of $10^{-3}$ mol per mol of silver. After being allowed to stand as it was for 15 minutes, the temperature of the reaction system was lowered.

Coating of Light-Sensitive Emulsion Layer

The emulsion prepared above was re-dissolved, and the redox compound and the compound of formula (I) of the invention as indicated in Table 1 below were added thereto at 40° C. Additionally, 5-methylbenzotriazole, 4-hydroxy-1,3,3a,7-tetraazaindene, the following compounds (a) and (b), 30 wt % to gelatin of polyethyl acrylate, and the following compound (c) of a gelatin-hardening agent were added thereto. The resulting composition was then coated on a polyethylene terephthalate film (thickness: 150 μm) having a vinylidene chloride copolymer-subbing layer (thickness: 0.5 μm), in the amount of 3.8 g/m² of silver.

(a)

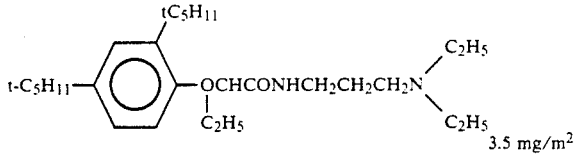

3.5 mg/m²

(b)

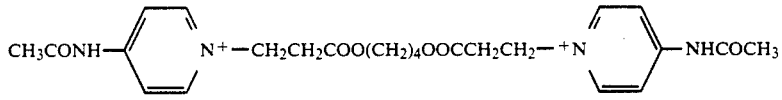

15.0 mg/m²

(c)

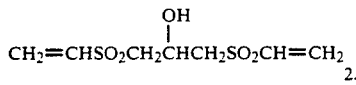

2.0 wt. % to gelatin

Coating of Photographic Layer

A protective layer comprising 1.5 g/m² of gelatin, 0.3 g/m² of polymethyl methacrylate grins (mean grain size: 2.5 microns), and the following surfactants was coated over the previously prepared emulsion layer.

Surfactants:

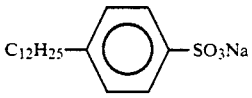

37 mg/m²

$CH_2COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

Evaluation of Photographic Properties (1) Halftone Dot Image Quality

The samples thus prepared were exposed to a tungsten light of 3200° K through an optical wedge and a contact screen (150 L Chain Dot Type, manufactured by Fuji Photo Film Co.) and then developed with the following developer for 30 seconds at 34° C. and thereafter fixed, rinsed in water and dried.

The dot image quality and the dot gradation of the thus processed samples were measured and the results obtained are shown in Table 1 below. The dot gradation was represented by the following formula:

(*) Dot Gradation (ΔlogE) =[amount of exposure giving a 95% dot area ratio (logE 95%)]−[amount of exposure giving a 5% dot area ratio (logE 5%)]

The dot quality was visually evaluated by five ranks. In the 5-rank evaluation, "5" is the best and "1" is the worst. The ranks "5" and "4" are practical for use as a dot image plate for photomechanical process; the rank "3" is the critical level for the practical use; and the ranks "2" and "1" indicate practically useless qualities.

The results obtained are shown in Table 1 below.

As is obvious from the results in Table 1, the compounds of the present invention were extremely effective for improving or broadening the dot gradation of the processed samples and therefore the samples containing the compounds of the invention had an extremely improved dot image quality, as compared with the comparative samples containing the comparative compounds.

In particular, the formation of the halftone dot image was smoothly effected in the samples of the present invention.

| Composition of Developer: | |
|---|---|
| Hydroquinone | 50.0 g |

-continued

| Composition of Developer: | |
|---|---|
| N-methyl-p-aminophenol | 0.3 g |
| Sodium Hydroxide | 18.0 g |
| 5-Sulfosalicylic acid | 55.0 g |
| Potassium sulfite | 110.0 g |
| Disodium Ethylenediamine-tetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonic acid | 0.2 g |
| N-n-butyldiethanolamine | 15.0 g |
| Sodium toluenesulfonate | 8.0 g |
| Water to make | 1 liter |
| Sodium hydroxide to make pH of | 11.6 |

(2) Line Image Quality

A letter original composed of Ming-style letters and Gothic-style letters of various grades printed by use of a phototypesetting machine was photographed on the samples by the use of a photomechanical process camera DSC-351 (manufactured by Dai-Nippon Screen Co.). The exposure time was adjusted so that the Ming-style letters with a line width of 40 μm could be reproduced to the same letter images with a line width of 40 μm.

The reproducibility of the letter images and the optical density (Dmax) of the background were evaluated for the respective samples.

(1) Reproducibility of Gothic-Style Letters

The reproducibility of Gothic-style letters was evaluated by 5-rank evaluation, where the rank "5" was the best and the rank "1" was the worst. The ranks "5" and "4" are practical for use as a dot image plate for photomechanical process; the rank "3" is the critical level for the practical use; and the ranks "2" and "1" indicate practically useless qualities.

The results obtained are shown in Table 1 below.

(2) Optical Density (Dmax) of Background

The blackened density of the portions, which correspond to the white background portions of the original, in the photographs was measured by the use of a Macbeth optical densitometer. The optical density (Dmax) is preferably higher, as the noise in the line image information is smaller.

The results obtained are shown in Table 1.

As is obvious from the results in Table 1, the samples of the present invention had an excellent line image reproducibility and gave a higher Dmax value.

The comparative compounds used are as follows:

Comparative Compound (a):

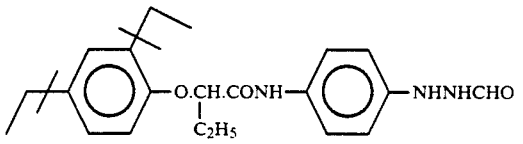

Comparative Compound (b):

-continued

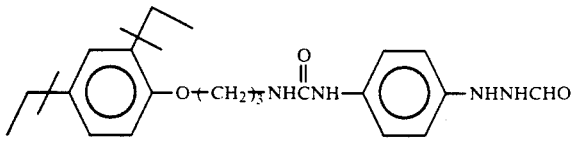

Comparative Compound (c):

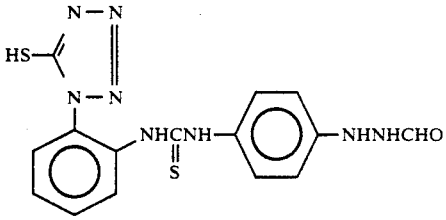

Comparative Compound (d):

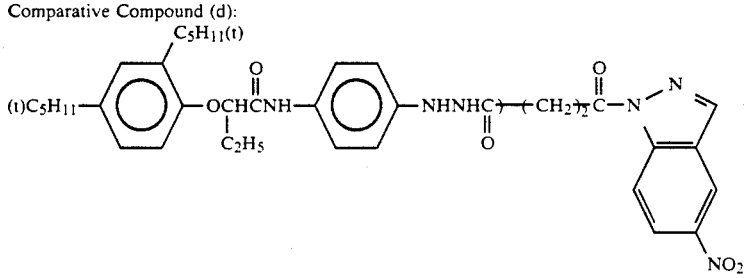

Comparative Compound (e):

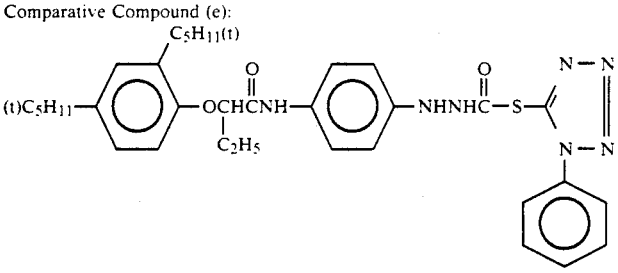

TABLE 1

| Sample | Redox Compound Kind | Redox Compound Amount Added (mol/Ag-mol) | Compound of Formula (I) Kind | Compound of Formula (I) Amount Added (mol/Ag-mol) | Halftone Image Gradation (ΔlogE) | Halftone Image Quality | Line Image Quality: Gothic Letter Reproducibility | Line Image Quality: Dmax |
|---|---|---|---|---|---|---|---|---|
| 1 (Comparison) | — | — | Comparative Compound-a | $2.0 \times 10^{-3}$ | 1.23 | 3 | 3 | 3.4 |
| 2 (Comparison) | — | — | Comparative Compound-b | $7.0 \times 10^{-4}$ | 1.21 | 3 | 3 | 2.9 |
| 3 (Comparison) | Comparative Compound-d | $5.7 \times 10^{-4}$ | Comparative Compound-a | $2.0 \times 10^{-3}$ | 1.33 | 4 | 4 | 3.8 |
| 4 (Comparison) | Comparative Compound-e | " | Comparative Compound-a | " | 1.21 | 2 | 3 | 3.3 |
| 5 (Comparison) | Comparative Compound-d | " | Comparative Compound-b | $7.0 \times 10^{-4}$ | 1.32 | 4 | 4 | 3.4 |
| 6 (Comparison) | Comparative Compound-e | " | Comparative Compound-b | " | 1.19 | 2 | 3 | 2.9 |
| 7 (Comparison) | Comparative Compound-d | " | Comparative Compound-c | $8.0 \times 10^{-4}$ | 1.27 | 3 | 2 | 2.5 |
| 8 (Comparison) | Comparative Compound-e | " | Comparative Compound-c | " | 1.19 | 2 | 2 | 2.3 |
| 1 (Invention) | II-17 | " | No. I-2 | $8.0 \times 10^{-5}$ | 1.47 | 5 | 5 | 4.3 |
| 2 (Invention) | " | " | I-3 | " | 1.49 | 5 | 5 | 4.5 |
| 3 (Invention) | " | " | I-11 | " | 1.46 | 4 | 5 | 4.3 |
| 4 (Invention) | II-19 | " | I-46 | " | 1.47 | 4 | 4 | 4.2 |
| 5 (Invention) | " | " | I-50 | " | 1.49 | 5 | 5 | 4.4 |
| 6 (Invention) | II-38 | " | I-54 | " | 1.49 | 5 | 5 | 4.3 |
| 7 (Invention) | " | " | I-56 | " | 1.51 | 5 | 5 | 4.6 |
| 8 (Invention) | II-19 | " | I-3 | " | 1.49 | 5 | 5 | 4.2 |
| 9 (Invention) | II-31 | " | I-3 | " | 1.47 | 5 | 5 | 4.4 |
| 10 (Invention) | II-35 | " | I-11 | " | 1.48 | 5 | 5 | 4.5 |
| 11 (Invention) | II-41 | $8.6 \times 10^{-5}$ | I-50 | " | 1.47 | 4 | 5 | 4.3 |

TABLE 1-continued

| Sample | Redox Compound Kind | Redox Compound Amount Added (mol/Ag-mol) | Compound of Formula (I) Kind | Compound of Formula (I) Amount Added (mol/Ag-mol) | Halftone Image Gradation (ΔlogE) | Halftone Image Quality | Line Image Quality: Gothic Letter Reproducibility | Line Image Quality: Dmax |
|---|---|---|---|---|---|---|---|---|
| 12 (Invention) | II-45 | " | I-50 | " | 1.49 | 5 | 4 | 4.5 |
| 13 (Invention) | II-51 | $5 \times 10^{-4}$ | I-50 | " | 1.50 | 5 | 5 | 4.4 |

EXAMPLE 2

The same samples as those in Example 1 were exposed in the same manner as in the procedure (1) for the evaluation of halftone dot image quality in Example 1 and then processed by the use of a photomechanical process automatic developing machine FG660F Type (manufactured by Fuji Photo Film Co., Ltd.), whereupon the same developer as that employed in Example 1 was filled in the machine. Accordingly, the samples were developed for 30 seconds at 34° C. under one of the following three conditions (A) to (C) and then fixed, rinsed in water and dried.

(A) Immediately after the temperature of the developer as added to the developing machine reached 34° C., the development was started. (Development with fresh solution)

(B) The developer as added to the developing machine was allowed to stand as it was for 4 days and then the development was started. (Development with air-fatigued solution)

(C) The developer was added to the developing machine, and 200 sheets/day of a 50%-exposed Fuji Film GRANDEX GA-100 (50.8 cm×61.0 cm) were developed with the machine repeatedly for 5 days. Afterwards, the samples of the example were developed with the thus used developer, whereupon 100 cc/sheet of a fresh developer was added. (Development with forcedly-fatigued solution)

The photographic properties of the thus processed samples are shown in Table 2 below. In view of the running processing stability, it is desired that the difference between the photographic properties obtained by the process (B) or (C) and those obtained by the process (A) is negligible. As is obvious from the results in Table 2, the running processing stability of the samples containing the compounds of the present invention was unexpectedly improved.

TABLE 2

| Sample No. | Running Processing Stability: Air-Fatigued Solution ($\Delta^S$B-A*) | Running Processing Stability: Forcedly-Fatigued Solution ($\Delta^S$C-A*) |
|---|---|---|
| 1 (Comparison) | +0.23 | −0.39 |
| 2 (Comparison) | +0.16 | −0.26 |
| 3 (Comparison) | +0.19 | −0.24 |
| 4 (Comparison) | +0.25 | −0.40 |
| 5 (Comparison) | +0.14 | −0.42 |
| 6 (Comparison) | +0.19 | −0.29 |
| 7 (Comparison) | +0.26 | −0.41 |
| 8 (Comparison) | +0.33 | −0.48 |
| 1 (Invention) | +0.05 | −0.08 |
| 2 (Invention) | +0.07 | −0.09 |
| 3 (Invention) | +0.04 | −0.07 |
| 4 (Invention) | +0.06 | −0.09 |
| 5 (Invention) | +0.09 | −0.09 |
| 6 (Invention) | +0.05 | −0.07 |
| 7 (Invention) | +0.03 | −0.06 |
| 8 (Invention) | +0.04 | −0.08 |
| 9 (Invention) | +0.04 | −0.07 |
| 10 (Invention) | +0.05 | −0.06 |
| 11 (Invention) | +0.08 | −0.14 |
| 12 (Invention) | +0.010 | −0.12 |

TABLE 2-continued

| Sample No. | Running Processing Stability: Air-Fatigued Solution ($\Delta^S$B-A*) | Running Processing Stability: Forcedly-Fatigued Solution ($\Delta^S$C-A*) |
|---|---|---|
| 13 (Invention) | +0.07 | −0.08 |

*($\Delta^S$B-A): Difference between the sensitivity ($S_B$) as developed with air-fatigued solution and the senstivity ($S_A$) as developed with fresh solution.
*($\Delta^S$C-A): Difference between the sensitivity ($S_C$) as developed with forcedly-fatigued solution and the senstivity ($S_A$) as developed with fresh solution.

EXAMPLE 3

An aqueous silver nitrate solution and an aqueous sodium chloride solution were simultaneously added to and blended with an aqueous gelatin solution of 50° C. in the presence of $5.0 \times 10^{-6}$ mol of $(NH_4)_3RhCl_6$ per mol of silver, and thereafter the soluble salts were removed therefrom by a method well known in this technical field. Then, gelatin was added thereto and, without being chemically ripened, a stabilizer of 2-methyl-4-hydroxy-1,3,3a,7-tetraazaindene was added thereto. The resulting emulsion was a monodispersed emulsion containing cubic grains having a mean grain size of 0.15 μm.

To the emulsion were added the redox compound and the compound of formula (I) of the invention as indicated in Table 3 below. Additionally, a polyethyl acrylate latex (30 wt % to gelatin) and a hardening agent of 1,3-vinylsulfonyl-2-propanol were added thereto. The resulting composition was coated on a polyester support in an amount of 3.8 g/m² of Ag. The gelatin content in the coated layer was 1.8 g/m². Next, a protective layer comprising gelatin (1.5 g/m²) and a matting agent of polymethyl methacrylate grains (mean grain size: 2.5 μm) (0.3 g/m²), and further containing the following surfactants as coating aids and stabilizer and ultraviolet absorbing dye was coated over the thus formed emulsion layer and dried thereon.

Surfactants:

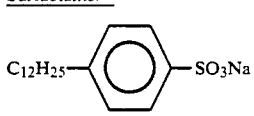

37 mg/m²

$CH_2COOC_6H_{13}$
|
$CHCOOC_6H_{13}$
|
$SO_3Na$ 37 mg/m²

$C_8F_{17}SO_2N(C_3H_7)CH_2COOK$ 2.5 mg/m²

Stabilizer:

Thiotic Acid 2.1 mg/m²

Ultraviolet Absorbing Dye:

100 mg/m²

-continued

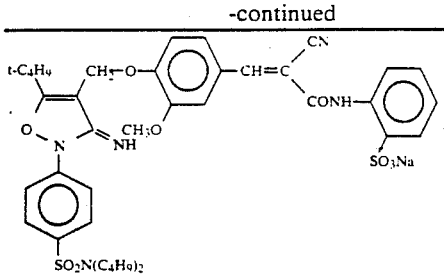

The thus prepared samples were imagewise exposed through the original of the Figure by the use of a daylight printer P-607 (manufactured by Dai-Nippon Screen Co.) and then developed at 38° C. for 20 seconds, fixed, rinsed in water and dried. The thus processed samples were evaluated with respect to the quality of the super-imposed letter image formed thereon by way of 5-rank evaluation.

For the 5-rank super-imposed letter image evaluation, the photographic material sample was properly exposed through the original of the Figure so that 50% of the dot area of the original could be 50% of the dot area of the reproduced image on the sample by contact dot-to-dot work. The rank "5" in the evaluation indicates that letters of 30 μm in width were well reproduced under the condition and the super-imposed letter image quality was excellent. The rank "1" therein indicates that only letters of 150 μm or more in width were reproduced under the same condition and the super-imposed letter image quality was bad. The other ranking of from "4" to "2" between the ranks "5" and "1" was conducted by functional evaluation. The ranks of "3" or more indicate the practical level.

The results obtained are shown in Table 3 below. As is obvious therefrom, the samples of the present invention had an excellent super-imposed letter image quality.

TABLE 3

| Sample No. | Redox Compound Kind | Redox Compound Amount Added (mol/Ag-mol) | Compound of Formula (I) Kind | Compound of Formula (I) Amount Added (mol/Ag-mol) | Super-Imposed Letter Image Quality | Running Processing Stability: Air-Fatigued Solution ($\Delta S_{B-A}^*$) | Running Processing Stability: Forcedly-Fatigue Solution ($\Delta S_{C-A}^*$) |
|---|---|---|---|---|---|---|---|
| 1 (Comparison) | — | — | Comparative Compound-a | $5.0 \times 10^{-3}$ | 2.5 | +0.17 | −0.25 |
| 2 (Comparison) | — | — | Comparative Compound-b | $1.8 \times 10^{-3}$ | 3.0 | +0.09 | −0.16 |
| 3 (Comparison) | Comparative Compound-d | $1.4 \times 10^{-3}$ | Comparative Compound-a | $5.0 \times 10^{-3}$ | 3.0 | +0.15 | −0.21 |
| 4 (Comparison) | Comparative Compound-e | " | Comparative Compound-a | " | 2.5 | +0.20 | −0.29 |
| 5 (Comparison) | Comparative Compound-d | " | Comparative Compound-b | $1.8 \times 10^{-3}$ | 3.5 | +0.07 | −0.13 |
| 6 (Comparison) | Comparative Compound-e | " | Comparative Compound-b | " | 3.0 | +0.13 | −0.20 |
| 7 (Comparison) | Comparative Compound-d | " | Comparative Compound-c | $2.1 \times 10^{-4}$ | 2.5 | +0.21 | −0.33 |
| 8 (Comparison) | Comparative Compound-e | " | Comparative Compound-c | " | 2.5 | +0.25 | −0.35 |
| 1 (Invention) | II-17 | " | No. I-2 | " | 4.0 | +0.03 | −0.05 |
| 2 (Invention) | " | " | I-3 | " | 4.0 | +0.06 | −0.05 |
| 3 (Invention) | " | " | I-11 | " | 4.0 | +0.03 | −0.05 |
| 4 (Invention) | II-19 | " | I-46 | " | 4.5 | +0.04 | −0.07 |
| 5 (Invention) | " | " | I-50 | " | 4.5 | +0.06 | −0.07 |
| 6 (Invention) | II-38 | " | I-54 | " | 4.5 | +0.03 | −0.05 |
| 7 (Invention) | " | " | I-56 | " | 4.5 | +0.03 | −0.04 |
| 8 (Invention) | II-19 | " | I-3 | " | 4.0 | +0.03 | −0.06 |
| 9 (Invention) | II-31 | " | I-3 | " | 4.0 | +0.03 | −0.05 |
| 10 (Invention) | II-35 | " | I-11 | " | 4.0 | +0.04 | −0.05 |
| 11 (Invention) | II-41 | $8.6 \times 10^{-3}$ | I-50 | " | 4.5 | +0.05 | −0.08 |
| 12 (Invention) | II-45 | " | I-50 | " | 4.5 | +0.05 | −0.08 |
| 13 (Invention) | II-51 | $1.4 \times 10^{-3}$ | I-50 | " | 4.5 | +0.04 | −0.08 |

EXAMPLE 4

The same samples as those in Example 3 were exposed in the same manner as in Example 2 and then processed by the use of a photomechanical process automatic developing machine FG660F Type (manufactured by Fuji Photo Film Co.), whereupon the same developer as that employed in Example 1 was filled in the machine. Accordingly, the samples were developed for 30 seconds at 34° C. under one of the following three conditions (A) to (C) and then fixed, rinsed in water and dried.

(A) Immediately after the temperature of the developer as filled in the developing machine reached 34° C., the development was started. (Development with fresh solution)

(B) The developer as filled in the developing machine was allowed to stand as it was for 4 days and then the development was started. (Development with air-fatigued solution)

(C) The developer was filled in the developing machine, and 200 sheets/day of a 50%-exposed Fuji Film GRANDEX GA-100 (50.8 cm×61.0 cm) were developed with the machine repeatedly for 5 days. Afterwards, the samples of the example were developed with the thus used developer, whereupon 100 cc/sheet of a fresh developer was replenished. (Development with forcedly-fatigued solution)

The photographic properties of the thus processed samples are shown in Table 3 above. In view of the running processing stability, it is desired that the difference between the photographic properties obtained by the process (B) or (C) and those obtained by the process (A) be negligible. As is obvious from the results in Table 3, the running processing stability of the samples containing the compounds of the present invention was unexpectedly improved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide photographic emulsion hydrophilic colloid layer and containing at least one redox compound capable of releasing a development inhibitor by oxidation with the oxidation product of a developer, represented by the following formula (II):

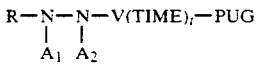

(II)

wherein $A_1$ and $A_2$ are both hydrogen atoms or one of them is a hydrogen atom and the other represents a sulfinic acid group or

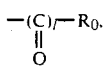

where $R_0$ represents an alkyl group, an alkenyl group, an aryl group, an alkoxy group or an aryloxy group and l represents 1 or 2;

Time represents a divalent linking group which contains a hetero atom through which the divalent linking group is bonded to the V group;

t represents 0 or 1;

PUG represents a development inhibitor group; V represents a carbonyl group,

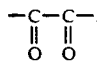

a sulfonyl group, a sulfoxyl group, an iminomethylene group, a thiocarbonyl group or

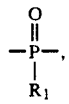

where $R_1$ means an alkoxy group or an aryloxy group; and

R represents an aliphatic group, an aromatic group or a heterocylic group; and at least one compound of the following general formula (I') in the photographic emulsion layer or in another hydrophilic colloid layer:

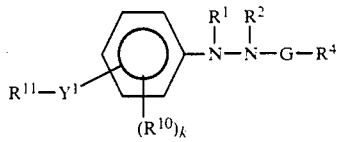

(I')

wherein $R^{10}$ represents an alkyl group, an aralkyl group, an alkoxy group, an arylamino group, an amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a phosphoric acid amido group and a carboxyl group or $X\text{-}(L)_l$—;

k represents 0, 1 or 2, and when k is 2, the two $(R^{10})$'s may be the same or different;

$R^{11}$ has the same meaning as $R^3$ below or represents $-(L)_l-X$;

L represents a divalent linking group, X represents a group selected from a cyclic thioamido-containing group, a mercapto-containing group, a disulfido bond-containing group and a 5-membered or 6-membered nitrogen-containing heterocylic group and l represents an integer of 0 or 1;

$Y^1$ represents —CONH—,

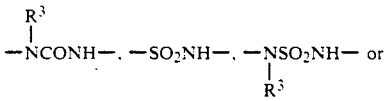

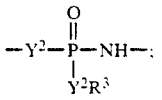

$Y^2$ represents —O, —NH— or

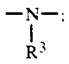

and wherein $R^1$ and $R^2$ are both hydrogen atoms, or one of them is a hydrogen atom and the other represents a sulfonyl group or an acyl group;

$R^3$ represents a group selected from an aliphatic group, an aromatic group and a heterocyclic group;

$R^4$ represents a group selected from a hydrogen atom, an alkyl group, an aryl group, an alkoxy group, an aryloxy group, an amino group, an oxycarbonyl group and a carbamoyl group;

at least one of $R^3$ and $R^4$ is substituted at the position of a hydrogen atom contained therein by a group which has a function of accelerating adsorption of the compound of formula (I') to silver halide grains and which is represented by X—(L)l— where X represents a group selected from a cyclic thioamido-containing group, a mercapto-containing group, a disulfido bond-containing group and a 5-membered or 6-membered nitrogen-containing heterocylic group;

L represents a divalent linking group, and l represents an integer of 0 or 1; and G represents a divalent group selected from a carbonyl group, a sulfonyl group, a sulfinyl group, an imino-methylene group and

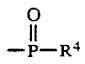

wherein $R^4$ is as defined above, provided that at least one of $R^{10}$ and $R^{11}$ is X—(L)l— when $R^4$ does not contain a group having a function of accelerating adsorption to silver halide grains.

2. The silver halide photographic material of claim 1, in which $R^4$ in formula (I') is such a group that causes release of the —G—$R^4$ moiety from the remaining molecule followed by a cyclization reaction to form a cyclic structure containing the atoms of the thus released —G—$R^4$ moiety.

3. The silver halide photographic material of claim 2, in which the group $R^4$ in formula (I') is represented by formula (a):

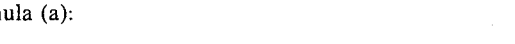

$$-R^5-Z \qquad (a)$$

where

Z represents a group which nucleophilically attacks the group G to cleave the —G—$R^5$—Z moiety from the remaining molecule;

$R^5$ represents a group derived from $R^4$ by removing one hydrogen atom therefrom; and Z is capable of nucleophilically attacking the group G so that G, $R^5$ and Z form a cyclic structure.

4. The silver halide photographic material of claim 3, in which the group of formula (a) is represented by formula (b):

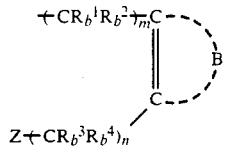

(b)

where $R_b^1$ to $R_b^4$ each represents a hydrogen atom, an alkyl group an alkenyl group or an aryl group, and they may be the same or different;

B represents an atomic group necessary for forming 5-membered or 6-membered ring which may or may not be substituted; and m and n each represents 0 or 1, and (n+m) is 1 or 2; and Z has the same meaning as in formula (a).

5. The silver halide photographic material of claim 3, in which the group of formula (a) is represented by formula (c);

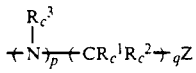

(c)

wherein $R_c^1$ and $R_c^2$ each represents a hydrogen atom, an alkyl group, an alkenyl group, an aryl group or a halogen atom, and they may be the same or different;

$R_c^3$ represents a hydrogen atom, an alkyl group, an alkenyl group or an aryl group;

p represents 1, 1 or 2;

q represents an integer from 1 to 4;

$R_c^1$, $R_c^2$ and $R_c^3$ may be bonded to each other to form a ring, provided that Z has a structure capable of attacking the group G by intramolecular nucleophilic reaction; and Z has the same meaning as in formula (a).

* * * * *